US008419921B2

(12) United States Patent
Tojo et al.

(10) Patent No.: US 8,419,921 B2
(45) Date of Patent: Apr. 16, 2013

(54) ELECTROLYTIC APPARATUS FOR PRODUCING FLUORINE OR NITROGEN TRIFLUORIDE

(75) Inventors: Tetsuro Tojo, Osaka (JP); Jiro Hiraiwa, Osaka (JP); Hitoshi Takebayashi, Osaka (JP); Masashi Kodama, Osaka (JP)

(73) Assignee: Toyo Tanso Co., Ltd., Osaka-Shi (JP)

( * ) Notice: Subject to any disclaimer, the term of this patent is extended or adjusted under 35 U.S.C. 154(b) by 0 days.

(21) Appl. No.: 13/372,751

(22) Filed: Feb. 14, 2012

(65) Prior Publication Data

US 2012/0138476 A1 Jun. 7, 2012

Related U.S. Application Data

(60) Division of application No. 11/798,146, filed on May 10, 2007, now Pat. No. 8,142,623, which is a continuation-in-part of application No. PCT/JP2007/050784, filed on Jan. 19, 2007.

(30) Foreign Application Priority Data

Jan. 20, 2006 (JP) ..... 2006-013255

(51) Int. Cl.
*C25B 9/08* (2006.01)
*C25B 1/00* (2006.01)
*C25B 1/24* (2006.01)

(52) U.S. Cl.
USPC ..... 205/615; 205/619; 205/334

(58) Field of Classification Search ..... 205/615, 205/619, 334
See application file for complete search history.

(56) References Cited

U.S. PATENT DOCUMENTS

| | | | |
|---|---|---|---|
| 5,688,384 | A | 11/1997 | Hodgson et al. |
| 6,818,105 | B2 | 11/2004 | Tojo et al. |
| 6,921,469 | B2 | 7/2005 | Larsen |
| 2004/0007457 | A1 | 1/2004 | Tojo et al. |

FOREIGN PATENT DOCUMENTS

| | | | |
|---|---|---|---|
| JP | 8-134675 | A | 5/1996 |
| JP | 9-505853 | A | 6/1997 |
| JP | 2000-149779 | A | 5/2000 |
| JP | 2001-295086 | A | 10/2001 |
| JP | 2004-52105 | A | 2/2004 |
| JP | 2004-231983 | A | 8/2004 |
| JP | 2005-21891 | A | 1/2005 |
| JP | 2005-97667 | A | 4/2005 |

OTHER PUBLICATIONS

International Search Report for International Patent Application No. PCT/JP2007/050784, mailed on May 1, 2007.

*Primary Examiner* — Harry D Wilkins, III
*Assistant Examiner* — Zulmariam Mendez
(74) *Attorney, Agent, or Firm* — Birch, Stewart, Kolasch & Birch, LLP

(57) ABSTRACT

It is a task of the present invention to provide an electrolytic apparatus for producing fluorine or nitrogen trifluoride by electrolyzing a hydrogen fluoride-containing molten salt, the electrolytic apparatus being advantageous in that the electrolysis can be performed without the occurrence of the anode effect even at a high current density and without the occurrence of an anodic dissolution. In the present invention, this task has been accomplished by an electrolytic apparatus for producing fluorine or nitrogen trifluoride by electrolyzing a hydrogen fluoride-containing molten salt at an applied current density of from 1 to 1,000 A/dm$^2$, the electrolytic apparatus using a conductive diamond-coated electrode as an anode.

3 Claims, 6 Drawing Sheets

Ratio of horizontal cross-sectional area of cathode chamber to horizontal cross-sectional area of anode chamber = 2

Ratio of horizontal cross-sectional area of cathode chamber to horizontal cross-sectional area of anode chamber = 3

Ratio of horizontal cross-sectional area of cathode chamber to horizontal cross-sectional area of anode chamber = 2

Ratio of horizontal cross-sectional area of cathode chamber to horizontal cross-sectional area of anode chamber = 0.5

(A)

Shape of electrolytic cell is rectangularly parallelepipedic

Shape of partition wall is rectangularly parallelepipedic (B)

Shape of electrolytic cell is cylindrical

Shape of partition wall is rectangularly parallelepipedic (C)

Shape of electrolytic cell is cylindrical

Shape of partition wall is cylindrical

ELECTROLYTIC APPARATUS FOR PRODUCING FLUORINE OR NITROGEN TRIFLUORIDE

This application is a Divisional of application Ser. No. 11/798,146 filed on May 10, 2007, now U.S. Pat. No. 8,142,623 which was a continuation-in-part of PCT Application No. PCT/JP2007/050784, filed on Jan. 19, 2007, which designated the United States and claimed priority to Japanese Application No. 2006-013255, filed on Jan. 20, 2006. Both priority applications are claimed under 35 U.S.C. §120. The entire contents of each of the above-identified applications are hereby incorporated by reference.

FIELD OF THE INVENTION

The present invention relates to an electrolytic apparatus for producing fluorine or nitrogen trifluoride. More particularly, the present invention is concerned with an electrolytic apparatus for producing fluorine or nitrogen trifluoride by electrolyzing a hydrogen fluoride-containing molten salt at an applied current density of from 1 to 1,000 A/dm$^2$, the electrolytic apparatus employing, as an anode, an electrode which is coated with conductive diamond.

By the use of the electrolytic apparatus of the present invention, it becomes possible to efficiently produce fluorine or nitrogen trifluoride without the occurrence of the anode effect even at a high current density and without the occurrence of an anodic dissolution. Therefore, the electrolytic apparatus of the present invention can be very advantageously used for producing fluorine or nitrogen trifluoride on a commercial scale.

BACKGROUND OF THE INVENTION

Fluorine is chemically the most active of all the elements. Therefore, fluorine as well as its compounds (e.g., nitrogen trifluoride) is widely used in various fields.

In the nuclear power industry, fluorine is used as a raw material for producing uranium hexafluoride ($UF_6$) (which is employed for concentration of uranium) and also as a raw material for producing sulfur hexafluoride ($SF_6$) (which is employed as a high dielectric constant gas). Further, in the semiconductor industry, fluorine is used as a gas for a dry washing or etching of the surface of silicon wafers by taking advantage of the properties of fluorine such that it reacts with silicon oxide coating and selectively reacts with impurity metals contained in silicon. In addition, in other industries, fluorine is used to control the gas permeability of a high density polyethylene which is employed as a material for a gasoline tank, and used to improve the wettability of olefin polymers. Olefin polymers are processed using a gaseous mixture of fluorine and oxygen, thereby introducing a carbonyl fluoride group (—COF) into the surface of the olefin polymers. A carbonyl fluoride group can be easily converted into a carboxyl group by a hydrolysis reaction (which is caused by, e.g., the moisture in the air), thereby improving the wettability of the olefin polymers.

On the other hand, nitrogen trifluoride ($NF_3$) has received much attention, since the time it was used in large amounts as a fuel/oxidant for rockets for planetary explorations which were planned and executed by the National Aeronautics and Space Administration (NASA) of the U.S.A. At the present day, in the semiconductor industry, nitrogen trifluoride is used in large amounts as a dry etching gas in the semiconductor manufacturing processes, and as a CVD chamber cleaning gas in the semiconductor manufacturing processes and liquid crystal display manufacturing processes. As a CVD chamber cleaning gas, a perfluorinated compound (PFC), such as carbon tetrafluoride ($CF_4$) or ethane hexafluoride ($C_2F_6$), is also used, but it has recently been found that a PFC is greatly promoting the global warming phenomenon. For this reason, the use of a PFC is likely to be restricted or banned at the global level by, e.g., the Kyoto Protocol. Thus, more and more nitrogen trifluoride is being used as a substitute gas for a PFC.

As described hereinabove, fluorine and nitrogen trifluoride are widely used in various fields. Therefore, it is important to efficiently produce fluorine or nitrogen trifluoride on a commercial scale.

Fluorine is produced exclusively by an electrolytic method, since it reacts with many substances so easily that it cannot be isolated by the conventional chemical oxidation method or the conventional substitution method. In the electrolytic method, fluorine is produced usually by using as an electrolysis liquid a hydrogen fluoride-containing molten salt of potassium fluoride (KF) and hydrogen fluoride (HF) wherein the molar ratio of KF to HF is ½ (which is hereinafter frequently referred to as an "HF-containing molten salt of a KF-2HF system").

On the other hand, the methods for producing nitrogen trifluoride are classified into a chemical method and an electrolytic method. In the chemical method, fluorine is first obtained by electrolysis using as an electrolysis liquid an HF-containing molten salt of a KF-2HF system, and then the fluorine is reacted with, e.g., a metal fluoride ammonium complex, thereby obtaining nitrogen trifluoride. In the electrolytic method, nitrogen trifluoride is produced directly by using as an electrolysis liquid an HF-containing molten salt of ammonium fluoride ($NH_4F$) and hydrogen fluoride (HF), or an HF-containing molten salt of ammonium fluoride, potassium fluoride (KF) and hydrogen fluoride.

In general, from the viewpoint of ease in machining process and a reduction in the conductor resistance, it is desired that a metal is used as a material for the electrodes of an electrolytic apparatus. However, in an electrolytic apparatus for producing fluorine or nitrogen trifluoride by using a hydrogen fluoride-containing molten salt, it is unsuitable to use a metal as an anode. The reason for this is that if a metal anode is used in the electrolysis of a hydrogen fluoride-containing molten salt for producing fluorine or nitrogen trifluoride, the metal will be dissolved vigorously, thus generating a metal fluoride sludge or forming a passivation layer which stops the current, thus rendering it impossible to continue the hydrolysis.

For example, in the electrolytic production of fluorine, if nickel is used as an anode, the nickel is corroded and dissolved vigorously during the electrolysis, thus forming a large amount of nickel fluoride sludge. Likewise, in the electrolytic production of nitrogen trifluoride, if nickel is used as an anode, the nickel will be corroded and dissolved vigorously during the electrolysis, thus forming a large amount of nickel fluoride sludge.

Thus, when the electrolytic production of fluorine or nitrogen trifluoride is conducted by using a metal as an anode and using a hydrogen fluoride-containing molten salt as an electrolysis liquid, the metal will be dissolved vigorously, thus forming a metal fluoride sludge. For this reason, it is necessary to regularly change electrodes and electrolysis liquids, thus rendering it difficult to continuously produce fluorine or nitrogen trifluoride. Further, if the current density is increased, dissolution of the metal is markedly increased, rendering it difficult to conduct the electrolysis at a high current density.

Therefore, in the electrolytic production of fluorine or nitrogen trifluoride by using a hydrogen fluoride-containing molten salt as an electrolysis liquid, carbon is conventionally used as an anode. However, the use of carbon as an anode causes the following problems.

First, the case of fluorine production is described. When fluorine is produced using carbon as an anode and using a hydrogen fluoride-containing molten salt (such as an HF-containing molten salt of a KF-2HF system) as an electrolysis liquid, the fluorine generation reaction represented by formula (1) below is caused by an electric discharge of a fluoride ion on the surface of the anode while generating graphite fluoride ($(CF)_n$)) by the reaction represented by formula (2) below. The surface energy of graphite fluoride is extremely low due to the presence of covalent C—F bonds therein, so that the wettability of graphite fluoride with the electrolysis liquid is poor. Graphite fluoride is decomposed by Joule heat into carbon tetrafluoride ($CF_4$), ethane hexafluoride ($C_2F_6$) or the like, as shown in the reaction represented by formula (3) below.

If the reaction rate of the reaction of formula (2) below (i.e., the graphite fluoride generation reaction) is higher than that of the reaction of formula (3) below (i.e., the graphite fluoride decomposition reaction), the surface of the carbon electrode will be coated with graphite fluoride, thus causing a decrease in the wettability of the carbon electrode with the electrolysis liquid, resulting in the stop of the current (the anode effect). A high current density increases the reaction rate of the reaction of formula (2) below, thereby promoting the anode effect.

$$HF_2^- \rightarrow (1/2)F_2 + HF + e^- \quad (1)$$

$$nC + nHF_2^- \rightarrow (CF)_n + nHF + e^- \quad (2)$$

$$(CF)_n \rightarrow xC + yCF_4, zC_2F_6, \text{etc} \quad (3)$$

As described below, a high concentration of water in the electrolysis liquid also promotes the anode effect. As shown in formula (4) below, the carbon at the surface of the carbon electrode reacts with water in the electrolysis liquid to generate graphite oxide ($C_xO(OH)_y$). Graphite oxide is so unstable that it undergoes a substitution reaction with atomic fluorine which is generated by an electric discharge of a fluoride ion, wherein the substitution reaction converts the graphite oxide into graphite fluoride ($(CF)_n$), as shown in formula (5) below (the atomic fluorine is generated as an intermediate product and, finally, converted into graphite fluoride). Further, the interlayers of the graphite are broadened by the generation of graphite oxide, thus promoting the diffusion of fluorine in the interlayers, resulting in an increase in the reaction rate of the reaction of formula (2) above (the graphite fluoride generation reaction). Thus, the anode effect is promoted.

$$xC + (y+1)H_2O \rightarrow C_xO(OH)_y + (y+2)H^+ + (y+2)e^- \quad (4)$$

$$C_xO(OH)_y + (x+3y+2)F^- \rightarrow (x/n)(CF)_n + (y+1)OF_2 + yHF + (x+3y+2)e^- \quad (5)$$

The occurrence of the anode effect decreases the wettability of the anode with the electrolysis liquid, thus reducing the production efficiency drastically. Hence, the occurrence of the anode effect poses a great problem in the use of carbon as an anode. For preventing the anode effect, it is required not only to perform a complicated operation, such as reducing the water concentration of the electrolysis liquid by dehydration electrolysis, but also to adjust the electrolytic current density to a level lower than the critical current density at which the anode effect occurs. The critical current density of a widely used carbon electrode is about 10 A/dm$^2$. A 1 to 5 weight % incorporation of a fluoride (such as lithium fluoride or aluminum fluoride) into the electrolysis liquid increases the critical current density. However, even by this method, the critical current density still remains at most about 20 A/dm$^2$.

On the other hand, in the case of nitrogen trifluoride production by electrolyzing a hydrogen fluoride-containing molten salt, using carbon as an anode, there also arise the same problems as described above. As mentioned above, the methods for producing nitrogen trifluoride can be classified into a chemical method and an electrolytic method.

In the chemical method, as described above, fluorine is first obtained by electrolysis, and then the fluorine is reacted with, e.g., a metal fluoride ammonium complex, thereby obtaining nitrogen trifluoride. When this method is employed, the problem of the occurrence of the anode effect is encountered in the step of producing fluorine by electrolysis.

In the case of electrolytic production of nitrogen trifluoride by using carbon as an anode, an HF-containing molten salt of ammonium fluoride ($NH_4F$) and hydrogen fluoride (HF), or an HF-containing molten salt of ammonium fluoride, potassium fluoride (KF) and hydrogen fluoride, is used as an electrolysis liquid. When this method is employed, the anode effect is encountered, as in the case of fluoride production using carbon as an anode and using an HF-containing molten salt of a KF-2HF system as an electrolysis liquid.

In addition, a problem arises in that carbon tetrafluoride ($CF_4$) and ethane hexafluoride ($C_2F_6$), which are generated by the reaction of formula (3) above (the graphite fluoride decomposition reaction), decrease the purity of nitrogen trifluoride which is the desired product. Nitrogen trifluoride, carbon tetrafluoride and ethane hexafluoride are extremely similar to each other with respect to the physical properties, thus rendering it difficult to separate them from each other by distillation. Therefore, it is necessary to employ a costly purification method for obtaining high purity nitrogen trifluoride.

Thus, the conventional method for producing fluorine or nitrogen trifluoride by electrolyzing a hydrogen fluoride-containing molten salt, using carbon as an anode, poses the problem of the occurrence of the anode effect. As described above, for preventing the anode effect, it is required not only to perform a complicated operation, such as reducing the water concentration of the electrolysis liquid by dehydration electrolysis, but also to adjust the electrolytic current density to a level lower than the critical current density at which the anode effect occurs.

Therefore, it has been desired to develop an electrolytic apparatus which can be operated without the occurrence of the anode effect even at a high current density and without the occurrence of an anodic dissolution.

[Patent Document 1] Unexamined Japanese Patent Application Laid-Open Specification No. Hei 7-299467

[Patent Document 2] Unexamined Japanese Patent Application Laid-Open Specification No. 2000-226682

[Patent Document 3] Unexamined Japanese Patent Application Laid-Open Specification No. Hei 11-269685

[Patent Document 4] Unexamined Japanese Patent Application Laid-Open Specification No. 2001-192874

[Patent Document 5] Unexamined Japanese Patent Application Laid-Open Specification No. 2004-195346

[Patent Document 6] Unexamined Japanese Patent Application Laid-Open Specification No. 2000-204492

[Patent Document 7] Unexamined Japanese Patent Application Laid-Open Specification No. 2004-52105

[Patent Document 8] Japanese Patent No. 364545

[Patent Document 9] Unexamined Japanese Patent Application Laid-Open Specification No. 2005-97667

[Non-Patent Document 1] "Fusso Kagaku To Kogyo (I): Shinpo To Oyo (Fluorine Chemistry and Industry (I): Progress and Application)", edited by Nobuatsu WATANABE, published in 1973 by The Kagaku Kogyo Ltd., Japan

[Non-Patent Document 2] "Fusso Kagaku To Kogyo (II): Shinpo To Oyo (Fluorine Chemistry and Industry (II): Progress and Application)", edited by Nobuatsu WATANABE, published in 1973 by The Kagaku Kogyo Ltd., Japan

[Non-Patent Document 3] "Diamond Electrochemistry", edited by Akira FUJISHIMA, published in 2005 by BKC Inc., Japan

DISCLOSURE OF THE INVENTION

Problems to be Solved by the Invention

A task of the present invention is to provide an electrolytic apparatus for producing fluorine or nitrogen trifluoride by electrolyzing a hydrogen fluoride-containing molten salt, the electrolytic apparatus being operable without the occurrence of the anode effect even at a high current density and without the occurrence of an anodic dissolution.

Means to Solve the Problems

In order to solve the above-mentioned problems accompanying the prior art, the present inventors have made extensive and intensive studies with a view toward developing an electrolytic apparatus for producing fluorine or nitrogen trifluoride by electrolyzing a hydrogen fluoride-containing molten salt, the electrolytic apparatus being operable without the occurrence of the anode effect even at a high current density and without the occurrence of an anodic dissolution. More specifically, the present inventors have made studies with a view toward developing an electrode which is free from the problem of a carbon electrode (i.e., the problem of the occurrence of the anode effect). In these studies, the present inventors have paid attention to electrodes which are coated with conductive diamond.

Conductive diamond is a material which is thermally and chemically stable. There have been proposed many electrolysis methods using an electrode which is coated with conductive diamond. For example, Patent Document 1 proposes a waste liquid disposal method in which organic matters in a waste liquid are subjected to oxidative decomposition by using a conductive diamond-coated electrode. Patent Document 2 proposes a waste water disposal method in which organic matters in waste water are subjected to electrochemical decomposition by using conductive diamond-coated electrodes as an anode and a cathode. Patent Document 3 proposes a method for synthesizing ozone by using a conductive diamond-coated electrode as an anode. Patent Document 4 proposes a method for synthesizing peroxosulfuric acid by using a conductive diamond-coated electrode as an anode. Patent Document 5 proposes a method for sterilizing microorganisms by using a conductive diamond-coated electrode as an anode. With respect to each of the conductive diamond-coated electrodes used in these prior art documents, the coating ratio (i.e., the ratio of the area of the electrode surface coated with a conductive diamond coating layer to the area of the entire surface of the electrode) is usually about 100%.

In these examples of prior art methods, however, the conductive diamond-coated electrodes are used to electrolyze an aqueous solution not containing hydrogen fluoride, and not used to electrolyze a hydrogen fluoride-containing molten salt.

Further, Patent Document 6 discloses a method in which a semiconductor diamond is used as an electrode in an electrolysis liquid containing a fluoride ion. However, this document is intended to perform an electroorganic fluorination by a method in which a dehydrogenation reaction is effected in a region in which the electric potential is less noble than the electric potential at which a fluoride ion undergoes an electric discharge reaction of formulae (1) and (2) above (i.e., the dehydrogenation reaction is effected in an electric potential region where a fluorine generation reaction does not occur), and the dehydrogenation reaction is followed by a fluorine substitution reaction. Therefore, this method is not applicable to a method for producing fluorine or nitrogen trifluoride by directly electrolyzing a hydrogen fluoride-containing molten salt. In fact, when the electrode described in Patent Document 6 is used to perform an electrolysis in an electric potential region where a fluoride ion undergoes an electric discharge reaction of formula (1) above (this reaction lowers the stability of a carbon electrode), the electrode will be collapsed, thus rendering it impossible to continue the electrolysis.

As described hereinabove, no prior art teaches or suggests that an electrode which is coated with conductive diamond is used for electrolyzing a hydrogen fluoride-containing molten salt.

In view of these problems, the present inventors have made studies for elucidating whether or not an electrode which is coated with conductive diamond can be used to electrolyze a hydrogen fluoride-containing molten salt. As a result, it has unexpectedly been found that, by the use of an electrolytic apparatus using a conductive diamond-coated electrode as an anode, the electrolysis can be efficiently performed without the occurrence of the anode effect even at a high current density. Further, it has also been found that, by the use of the electrode, not only can there be prevented the sludge formation caused by electrode erosion, but also there can be suppressed the generation of carbon tetrafluoride gas. Based on these novel findings, the present invention has been completed.

Accordingly, it is a primary object of the present invention to provide an electrolytic apparatus for producing fluorine or nitrogen trifluoride by electrolyzing a hydrogen fluoride-containing molten salt, the electrolytic apparatus being operable without the occurrence of the anode effect even at a high current density and without the occurrence of an anodic dissolution.

The foregoing and other objects, features and advantages of the present invention will be apparent from the following detailed description taken in connection with the accompanying drawings, and the appended claims.

Effect of the Invention

By the use of the electrolytic apparatus of the present invention, it becomes possible to produce fluorine or nitrogen trifluoride without causing the anode effect even when the electrolysis is performed at a high current density. Therefore, the electrolytic apparatus of the present invention does not need a large number of electrodes and, hence, a miniaturization of the electrolytic apparatus of the present invention becomes possible. Further, in the electrolysis performed using the electrolytic apparatus of the present invention, the generation of sludge due to erosion of the electrodes can be prevented, and the amount of carbon tetrafluoride generated can be suppressed to a minimum.

BRIEF DESCRIPTION OF THE DRAWINGS

FIG. 6(A) shows a case where both the electrolytic cell and the partition wall are rectangularly parallelepipedic. FIG. 6(B) shows a case where the electrolytic cell is cylindrical and the partition wall is rectangularly parallelepipedic. FIG. 6(C) shows a case where both the electrolytic cell and the partition wall are cylindrical.

DESCRIPTION OF REFERENCE NUMERALS

Figure 1:
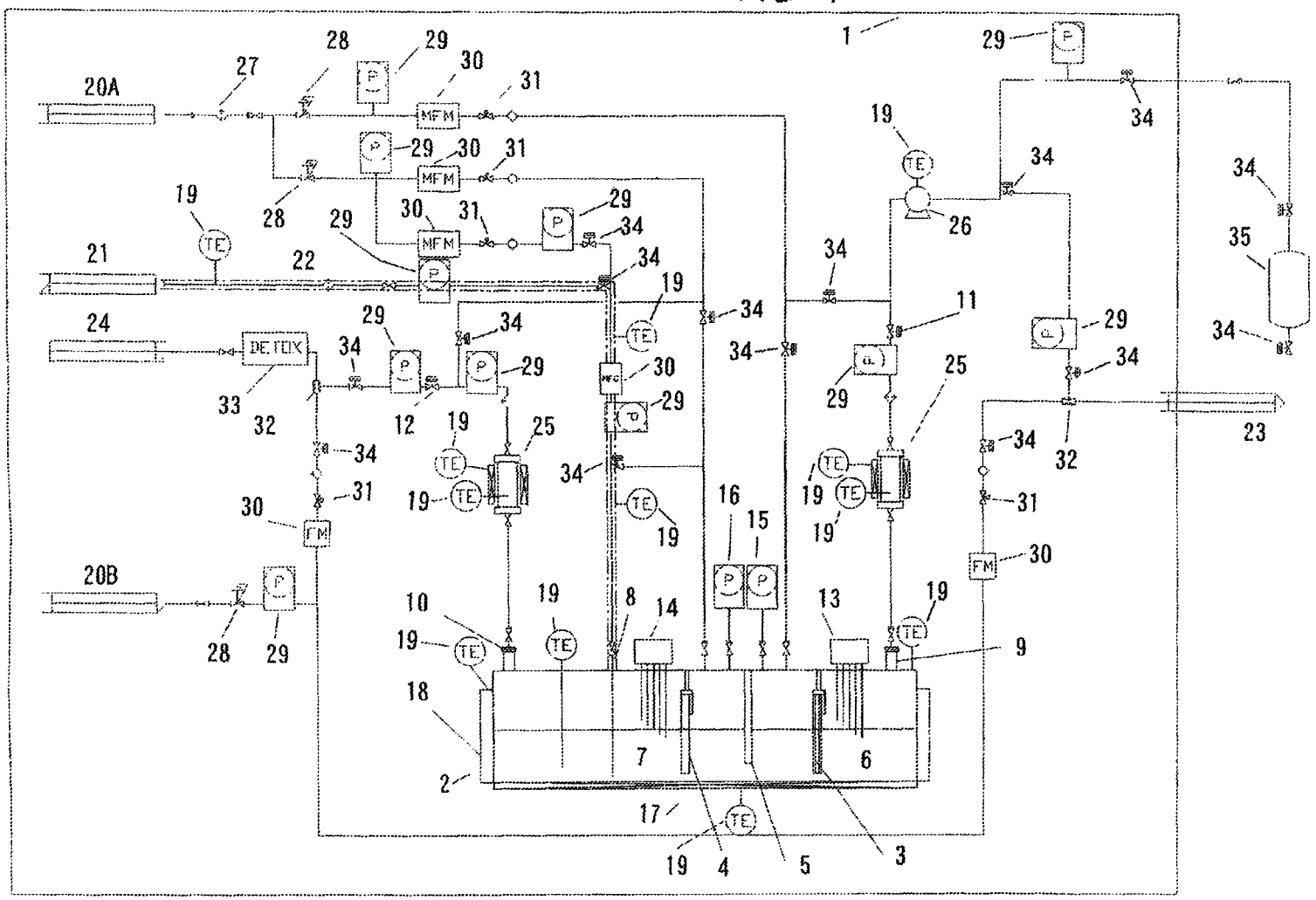
FIG. 1 is a schematic view of an example of the system of the present invention.
Figure 2:
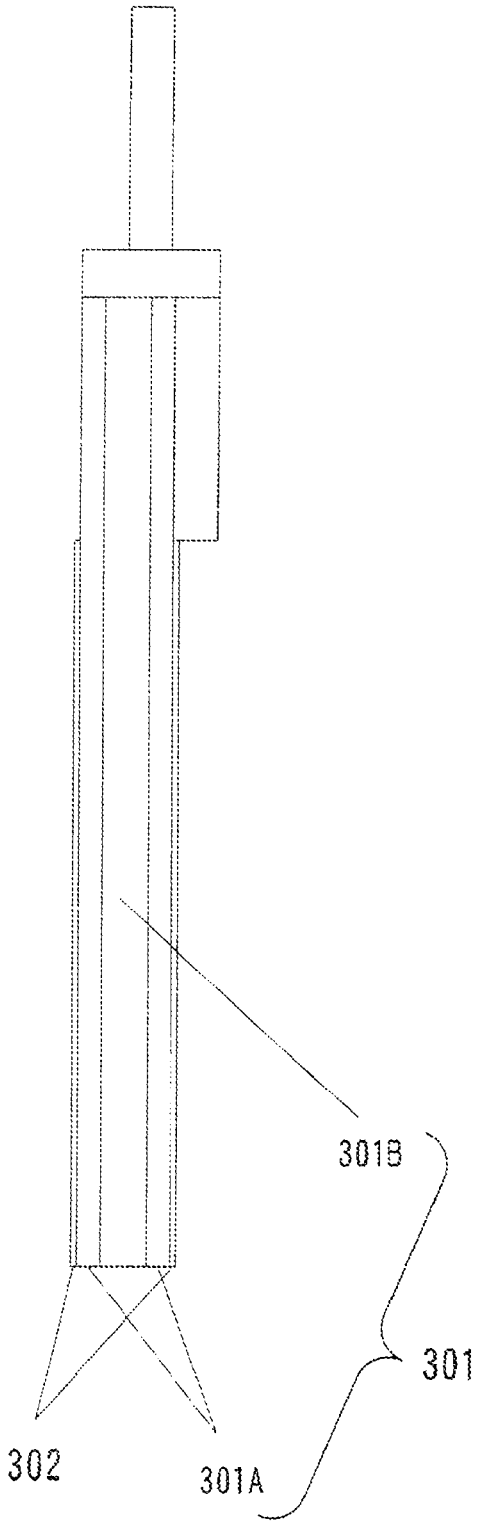
FIG. 2 is a schematic view of an example of the anode used in the electrolytic apparatus of the present invention.
Figure 3:
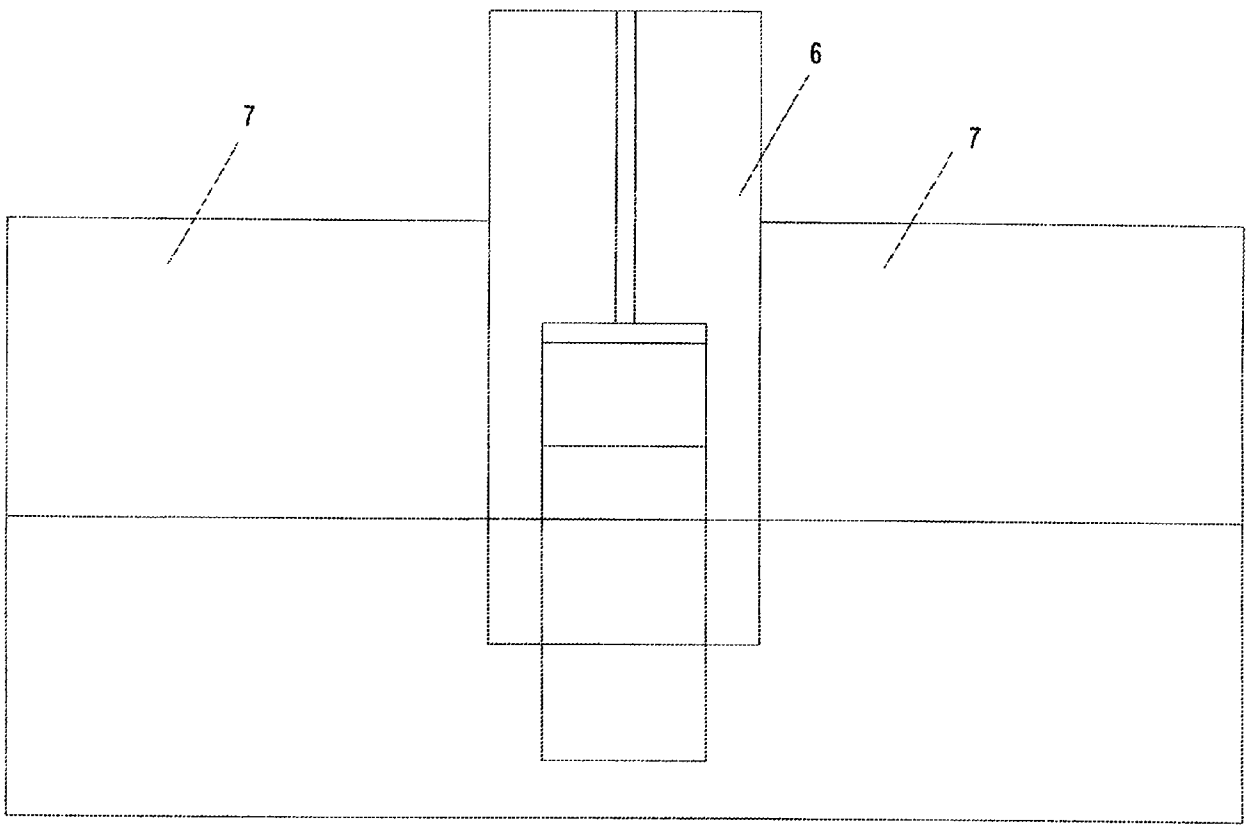
FIG. 3 is a schematic view of an example of the electrolytic cell used in the present invention, wherein the ratio of the horizontal cross-sectional area of the cathode chamber to the horizontal cross-sectional area of the anode chamber is 3.
Figure 4:
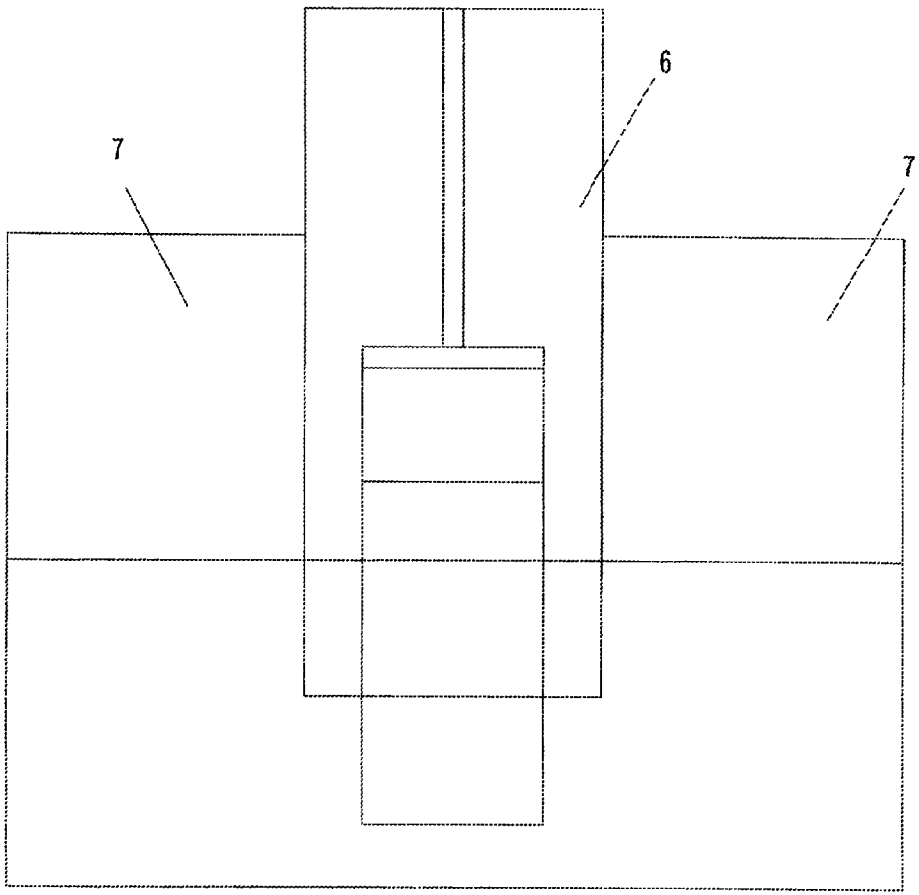
FIG. 4 is a schematic view of an example of the electrolytic cell used in the present invention, wherein the ratio of the horizontal cross-sectional area of the cathode chamber to the horizontal cross-sectional area of the anode chamber is 2.
Figure 5:
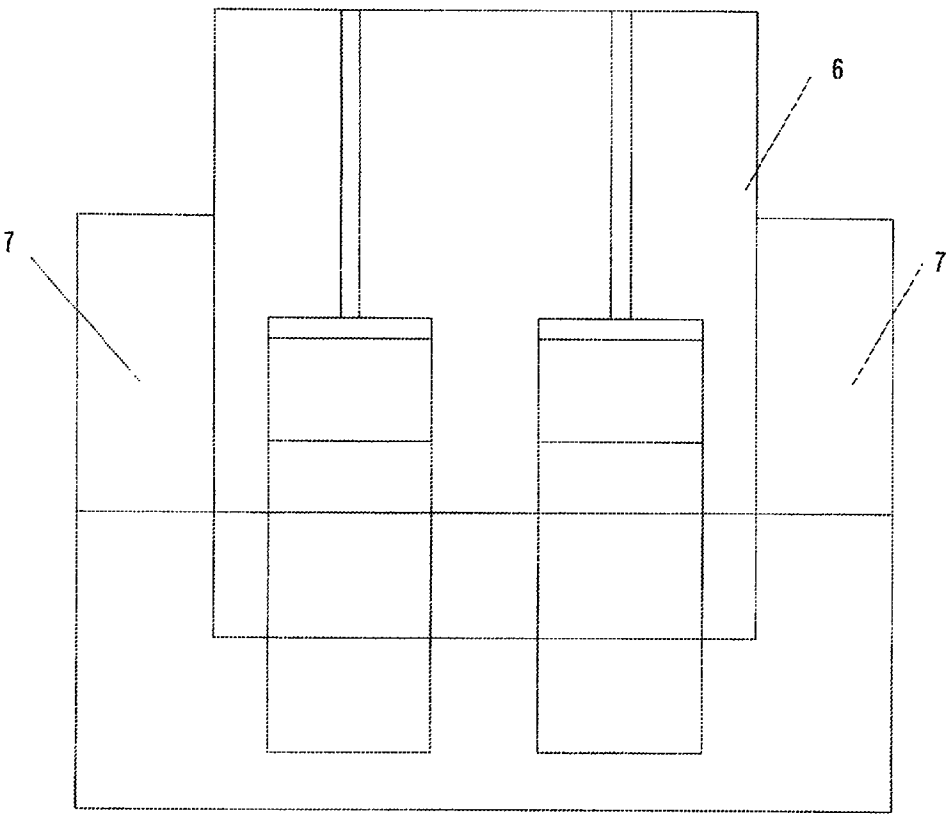
FIG. 5 is a schematic view of an example of the electrolytic cell used in the present invention, wherein the ratio of the horizontal cross-sectional area of the cathode chamber to the horizontal cross-sectional area of the anode chamber is 0.5.

1: Casing
2: Electrolytic cell
3: Anode
4: Cathode
5: Skirt (Partition wall)
6: Anode chamber
7: Cathode chamber
8: HF inlet
9: Anode gas outlet
10: Cathode gas outlet
11: Automatic valve for adjusting anode chamber pressure
12: Automatic valve for adjusting cathode chamber pressure
13: Anode chamber liquid surface detecting means
14: Cathode chamber liquid surface detecting means
15: Anode chamber pressure detecting means
16: Cathode chamber pressure detecting means
17: Bottom heater
18: Jacket heater
19: Thermocouple
20A: Inert gas feeding means
20B: Inert gas feeding means
21: HF gas feeding
22: HF line heater
23: Discharge of $F_2$
24: Discharge of $H_2$
25: Purification apparatus
26: Pressurizing apparatus
27: Filter
28: Decompression valve
29: Pressure meter
30: Flow meter
31: Flow rate adjusting valve
32: Ejector (Vacuum generator)
33: Detoxification column
34: Automatic valve
35: Reactor
301: Conductive substrate
301A: Surface portion of conductive substrate (Conductive carbonaceous material)
301B: Interior of conductive substrate (Conductive carbonaceous material or another material)
302: Coating layer comprised of conductive carbonaceous material having diamond structure

BEST MODE FOR CARRYING OUT THE INVENTION

According to the present invention, there is provided an electrolytic apparatus for producing fluorine or nitrogen trifluoride by electrolyzing a hydrogen fluoride-containing molten salt at an applied current density of from 1 to 1,000 A/dm$^2$, which comprises:

an electrolytic cell which is partitioned into an anode chamber and a cathode chamber by a partition wall, an anode which is disposed in the anode chamber, and a cathode which is disposed in the cathode chamber, the electrolytic cell having an inlet for feeding thereto a hydrogen fluoride-containing molten salt as an electrolysis liquid or a raw material for the hydrogen fluoride-containing molten salt, the anode chamber having an anode gas outlet for withdrawing gas from the electrolytic cell, the cathode chamber having a cathode gas outlet for withdrawing gas from the electrolytic cell, the anode comprising a conductive substrate and a coating layer formed on at least a part of the surface of the conductive substrate, wherein at least a surface portion of the conductive substrate is comprised of a conductive carbonaceous material, and wherein the coating layer is comprised of a conductive carbonaceous material having a diamond structure.

For easier understanding of the present invention, the essential features and various preferred embodiments of the present invention are enumerated below.

1. An electrolytic apparatus for producing fluorine or nitrogen trifluoride by electrolyzing a hydrogen fluoride-containing molten salt at an applied current density of from 1 to 1,000 A/dm$^2$, which comprises:

an electrolytic cell which is partitioned into an anode chamber and a cathode chamber by a partition wall, an anode which is disposed in the anode chamber, and a cathode which is disposed in the cathode chamber, the electrolytic cell having an inlet for feeding thereto a hydrogen fluoride-containing molten salt as an electrolysis liquid or a raw material for the hydrogen fluoride-containing molten salt, the anode chamber having an anode gas outlet for withdrawing gas from the electrolytic cell, the cathode chamber having a cathode gas outlet for withdrawing gas from the electrolytic cell, the anode comprising a conductive substrate and a coating layer formed on at least a part of the surface of the conductive substrate, wherein at least a surface portion of the conductive substrate is comprised of a conductive carbonaceous material, and wherein the coating layer is comprised of a conductive carbonaceous material having a diamond structure.

2. The electrolytic apparatus according to item 1 above, wherein the whole of the conductive substrate is comprised of a conductive carbonaceous material.

3. The electrolytic apparatus according to item 1 or 2 above, wherein the ratio of the horizontal cross-sectional area of the cathode chamber to the horizontal cross-sectional area of the anode chamber is 2 or more.

4. The electrolytic apparatus according to item 3 above, wherein the electrolytic cell is columnar.

5. The electrolytic apparatus according to item 4 above, wherein the electrolytic cell is cylindrical or rectangularly parallelepipedic.

6. The electrolytic apparatus according to item 1 or 2 above, which is provided with an anode chamber pressure adjusting means for adjusting the internal pressure of the anode chamber and a cathode chamber pressure adjusting means for adjusting the internal pressure of the cathode chamber.

7. The electrolytic apparatus according to item 1 or 2 above, wherein:

the anode chamber is provided with an anode chamber liquid surface detecting means for detecting the height of the surface of the electrolysis liquid in the anode chamber, and the cathode chamber is provided with a cathode chamber liquid surface detecting means for detecting the height of the surface of the electrolysis liquid in the cathode chamber.

8. The electrolytic apparatus according to item 1 or 2 above, which is provided with a temperature adjusting means for adjusting the internal temperature of the electrolytic apparatus.

9. The electrolytic apparatus according to item 1 or 2 above, which is provided with an inert gas feeding means for feeding an inert gas to the cathode chamber.

10. A method for electrolytic production of fluorine or nitrogen trifluoride, comprising electrolyzing, by the use of the electrolytic apparatus of item 9 above, a hydrogen fluoride-containing molten salt at an applied current density of from 100 to 1,000 A/dm$^2$ while feeding an inert gas to the cathode chamber by using the inert gas feeding means.

11. A method for feeding fluorine or nitrogen trifluoride to a reactor for performing a reaction using fluorine or nitrogen trifluoride, which comprises producing fluorine or nitrogen trifluoride by the use of the electrolytic apparatus of item 1 or 2 above, and feeding the produced fluorine or nitrogen trifluoride to a reactor for performing a reaction using fluorine or nitrogen trifluoride.

12. A system for feeding fluorine or nitrogen trifluoride to a reactor for performing a reaction using fluorine or nitrogen trifluoride, the system comprising:

the electrolytic apparatus of item 1 or 2 above, and a purification apparatus for purifying fluorine or nitrogen trifluoride produced using the electrolytic apparatus, wherein, in operation, feeding of fluorine or nitrogen trifluoride from the system to a reactor for performing a reaction using fluorine or nitrogen trifluoride is performed through the purification apparatus.

13. The system according to item 12 above, which is provided with a means for mixing gas withdrawn from the cathode gas outlet with an inert gas to dilute the gas withdrawn, followed by removal of the resultant diluted gas from the system.

14. The system according to item 12 above, wherein the electrolytic apparatus and the purification apparatus are accommodated in a casing.

15. A system for feeding fluorine or nitrogen trifluoride to a reactor for performing a reaction using fluorine or nitrogen trifluoride, the system comprising:

the electrolytic apparatus of item 1 or 2 above, and a pressurizing apparatus for pressurizing fluorine or nitrogen trifluoride produced using the electrolytic apparatus, wherein, in operation, feeding of fluorine or nitrogen trifluoride from the system to a reactor for performing a reaction using fluorine or nitrogen trifluoride is performed through the pressurizing apparatus.

16. The system according to item 15 above, which is provided with a means for mixing gas withdrawn from the cathode gas outlet with an inert gas to dilute the gas withdrawn, followed by removal of the resultant diluted gas from the system.

17. The system according to item 15 above, wherein the electrolytic apparatus and the pressurizing apparatus are accommodated in a casing.

18. A system for feeding fluorine or nitrogen trifluoride to a reactor for performing a reaction using fluorine or nitrogen trifluoride, the system comprising:

the electrolytic apparatus of item 1 or 2 above, a purification apparatus for purifying fluorine or nitrogen trifluoride produced using the electrolytic apparatus, and a pressurizing apparatus for pressurizing fluorine or nitrogen trifluoride purified using the purification apparatus, wherein, in operation, feeding of fluorine or nitrogen trifluoride from the system to a reactor for performing a reaction using fluorine or nitrogen trifluoride is performed through the pressurizing apparatus.

19. The system according to item 18 above, which is provided with a means for mixing gas withdrawn from the cathode gas outlet with an inert gas to dilute the gas withdrawn, followed by removal of the resultant diluted gas from the system.

20. The system according to item 18 above, wherein the electrolytic apparatus, the purification apparatus and the pressurizing apparatus are accommodated in a casing.

Hereinbelow, the present invention is described in detail with reference to reference numerals used in FIGS. 1 to 5.

With respect to the electrolytic apparatus of the present invention, an explanation is given below. The electrolytic apparatus of the present invention is an electrolytic apparatus for producing fluorine or nitrogen trifluoride by electrolyzing a hydrogen fluoride-containing molten salt at an applied current density of from 1 to 1,000 A/dm$^2$. The electrolytic apparatus comprises an electrolytic cell 2 which is partitioned into an anode chamber 6 and a cathode chamber 7 by a partition wall 5, an anode 3 which is disposed in the anode chamber 6, and a cathode 4 which is disposed in the cathode chamber 7. The electrolytic cell 2 has an inlet 8 for feeding thereto a hydrogen fluoride-containing molten salt as an electrolysis liquid or a raw material for the hydrogen fluoride-containing molten salt. In general, the inlet 8 is provided in the cathode chamber 7. The anode chamber 6 has an anode gas outlet 9 for withdrawing gas from the electrolytic cell 2. The cathode chamber 7 has a cathode gas outlet 10 for withdrawing gas from the electrolytic cell 2.

If desired, the electrolytic apparatus of the present invention may further comprise components other than mentioned above. In the present invention, with respect to the components other than the anode, there can be used those which are conventionally used in the field of the electrolysis of a hydrogen fluoride-containing molten salt. Also, the structure of the electrolytic apparatus may be the same as that of an electrolytic apparatus which is conventionally used for electrolyzing a hydrogen fluoride-containing molten salt. With respect to the components and structures of such conventional electrolytic apparatuses, reference can be made to, for example, Patent Documents 7 and 8 and non-Patent Documents 1 and 2.

With respect to the anode 3 used in the present invention, an explanation is given. The anode 3 used in the present invention comprises a conductive substrate 301 and a coating layer 302 formed on at least a part of the surface of the conductive substrate 301, wherein at least a surface portion 301A of the conductive substrate 301 is comprised of a conductive carbonaceous material, and wherein the coating layer 302 is comprised of a conductive carbonaceous material having a diamond structure (hereinafter, this electrode is frequently referred to as a "conductive diamond-coated electrode").

With respect to the conductive carbonaceous material having a diamond structure, there is no particular limitation so long as the conductive carbonaceous material has a diamond structure. Examples of conductive carbonaceous materials having a diamond structure include conductive diamond and conductive diamond-like carbon. Both conductive diamond and conductive diamond-like carbon are thermally and chemically stable materials. These materials can be used individually or in combination. As the conductive carbonaceous material having a diamond structure, it is preferred to use conductive diamond.

A surface portion 301A of the conductive substrate 301 is comprised of a conductive carbonaceous material. As the conductive carbonaceous material for the surface portion 301A of the conductive substrate 301, there is generally used a material which is chemically stable to atomic fluorine generated by the discharge of a fluoride ion. For example, there can be used a material (such as amorphous carbon) which forms graphite fluoride ($(CF)_n$) to thereby prevent itself from being destroyed by the generation of a fluorine-graphite intercalation compound. Also, conductive diamond may be used as a material for the surface portion 301A of the conductive substrate 301.

As a material for the interior portion 301B of the conductive substrate 301, there can be used a carbonaceous material (amorphous carbon), niobium, zirconium and the like. The type of the material used for the surface portion 301A of the conductive substrate 301 may be the same as or different from the type of the material used for the interior portion 301B of the conductive substrate 301. For example, the whole of the conductive substrate 301 may be comprised of graphite.

When the conductive substrate is completely coated with a layer comprised of a conductive carbonaceous material having a diamond structure (hereinafter, this layer is frequently referred to as a "conductive diamond coating layer"), the type of the material used for the conductive substrate, with respect to both the surface and interior portions thereof, is not specifically limited so long as the material is conductive. On the other hand, when the conductive substrate has a surface portion thereof which, even if very small, is exposed without being coated with the conductive diamond coating layer, a material which is not chemically stable to atomic fluorine generated by the discharge of a fluoride ion cannot be suitably used as the material for the surface portion of the conductive substrate. More specifically, when such conductive substrate (having its surface portion comprised of a chemically unstable material) is exposed without being coated with the conductive diamond coating layer, the anode employing such chemically unstable conductive substrate will be destroyed from the exposed portion of the conductive substrate during the electrolysis, so that it becomes impossible to continue the electrolysis.

In practice, the conductive diamond coating layer becomes polycrystalline and, hence, it is difficult to completely coat the conductive substrate with the conductive diamond coating layer without any coating defects which cause exposure of the conductive substrate. Therefore, as mentioned above, a material which is chemically stable to atomic fluorine generated by the discharge of a fluoride ion is generally used as the material for the surface portion of the conductive substrate.

As the conductive substrate, there can also be used a metal material (such as nickel or stainless steel) which is coated with an extremely dense carbonaceous material, such as conductive diamond-like carbon or glassy carbon.

With respect to the shape of the conductive substrate, there is no particular limitation. Examples of the shape of the conductive substrate include a plate, a mesh, a rod, a pipe and a sphere, such as a bead. Preferred is a conductive substrate having the shape of a plate. With respect also to the size of the conductive substrate, there is no particular limitation. As a conductive substrate having the shape of a plate, there has conventionally, commercially been employed, for example, a conductive substrate having a size of 200 mm (width)×600 mm (length)×50 mm (thickness). In the present invention, there can be used, for example, a conductive substrate having a width of from about 200 mm to about 280 mm, a length of from about 340 mm to about 530 mm and a thickness of from about 50 mm to 70 mm.

When the type of the material used for the surface portion of the conductive substrate is different from the type of the material used for the interior portion of the conductive substrate, the surface portion of the conductive substrate forms a surface layer which is distinct from the layer of the interior portion of the conductive substrate. In this case, the thickness of the surface layer of the conductive substrate is generally from 0.5 to 20 μm, preferably from 0.5 to 10 μm, more preferably from 0.5 to 5 μm. With respect to the thickness of the layer of the interior portion of the conductive substrate, there is no particular limitation so long as the anode maintains a satisfactory strength as an electrode. The thickness of the layer of the interior portion of the conductive substrate is generally 1 mm or more.

With respect to the thickness of the conductive diamond coating layer, there is no particular limitation; however, from the viewpoint of economy, the thickness of the conductive diamond coating layer is preferably from 1 to 20 μm, more preferably from 1 to 10 μm. The thickness of the conductive diamond coating layer may or may not be uniform; however, it is preferred that the thickness of the conductive diamond coating layer is uniform.

Conductive diamond can be used as the material for the surface portion and/or interior portion of the conductive substrate. However, from the viewpoint of economy, it is preferred that a material other than conductive diamond is used for the surface portion and interior portion of the conductive substrate.

As mentioned above, at least a part of the conductive substrate is coated with the conductive diamond coating layer. With respect to the coating with the conductive diamond coating layer, the ratio of the area of the coated-portion of the surface of the conductive substrate to the entire surface area of the conductive substrate is generally 10% or more, preferably 50% or more, more preferably 70% or more, still more preferably 90% or more, most preferably 100% (hereinafter, this area ratio is frequently referred to as a "coating ratio"). When the coating ratio is less than 10%, a problem is caused in that it becomes difficult to perform the electrolysis at a high current density.

As mentioned above, the coating ratio is most preferably 100%. However, from the viewpoint of economy, it is unusual to use an anode having a coating ratio of 100%. For example, when it is intended to form a conductive diamond coating layer on a conductive substrate having the shape of a plate, a coating layer is usually formed on each of the upper and lower surfaces of the conductive substrate (i.e., the opposite broad surfaces of the conductive substrate; in other words, the two surfaces of the conductive substrate which are perpendicular to the thicknesswise direction of the conductive substrate), wherein no coating layer is formed on the other four surfaces of the conductive substrate (i.e., the four lateral surfaces of the conductive substrate; in other words, the four surfaces of the conductive substrate which are parallel to the thicknesswise direction of the conductive substrate).

With respect to the method for producing the conductive diamond-coated electrode, an explanation is given below. A conductive diamond-coated electrode can be produced by forming a conductive diamond coating layer on the conductive substrate. With respect to the method for forming a conductive diamond coating layer on the conductive substrate, there is no particular limitation. Representative examples of such methods include a hot filament CVD (chemical vapor deposition) method, a microwave plasma CVD method, a plasma arcjet method and a PVD (physical vapor deposition) method. With respect to these methods, reference can be made, for example, to non-Patent Document 3. As an example of a commercially available apparatus used for these methods, there can be mentioned a hot filament CVD apparatus manufactured and sold by SP3 Co., Ltd., U.S.A.

In any of the above-mentioned methods, as a material for forming diamond, there is used a gaseous mixture of hydrogen gas and a carbon source gas, wherein an element having an atomic value different from that of carbon is incorporated in a very small amount into the gaseous mixture for imparting conductivity to diamond (hereinafter, such an element used for imparting conductivity is frequently referred to as a "dopant"). As the dopant, it is preferred to use boron, phosphorus or nitrogen. Boron is more preferred. The amount of the dopant is preferably from 1 to 100,000 ppm, more preferably from 100 to 10,000 ppm, based on the weight of the conductive diamond coating layer.

In any of the above-mentioned methods, the conductive diamond coating layer formed on the conductive substrate generally has a polycrystalline structure and contains amorphous carbon and graphite, wherein the contents of amorphous carbon and graphite in the conductive diamond coating layer are substantially the same. From the viewpoint of the stability of the conductive diamond coating layer, it is preferred that the contents of amorphous carbon and graphite in the conductive diamond coating layer are as small as possible. For the sake of exactness, the amount of diamond in the conductive diamond coating layer is expressed in terms of the ratio of the intensity of a band ascribed to diamond to the intensity of a band ascribed to graphite, wherein these bands are observed in a Raman spectroscopic analysis (it is not necessary to pay attention to the intensity of a band ascribed to amorphous carbon in the Raman spectroscopic analysis, since the amorphous carbon content is substantially the same as the graphite content). Specifically, in the Raman spectroscopic analysis, it is preferred that the ratio I(D)/I(G) is larger than 1, wherein I(D) means the intensity of a peak appearing around 1,332 $cm^{-1}$ (in the range of from 1,312 to 1,352 $cm^{-1}$) and being ascribed to diamond, and I(G) means the intensity of a peak appearing around 1,580 $cm^{-1}$ (in the range of from 1,560 to 1,600 $cm^{-1}$) and being ascribed to the G band of graphite. Simply stated, it is preferred that the diamond content is larger than the graphite content. The above-mentioned ratio I(D)/I(G) is more preferably 2 or more, still more preferably 3 or more, still more preferably 3.6 or more, still more preferably 4 or more, still more preferably 5 or more.

With respect to the hot filament CVD (chemical vapor deposition) method for the formation of a conductive diamond coating layer on the conductive substrate, an explanation is given below. In this method, first, an organic compound (such as methane, ethanol or acetone) as a carbon source and a dopant are charged into the hot filament CVD apparatus together with hydrogen gas. When methane is fed as a carbon source to the CVD apparatus together with a dopant and hydrogen gas, the amounts of methane and dopant are, for example, respectively 0.1 to 10% by volume and 0.02 to 2% by volume, based on the total volume of methane, the dopant and hydrogen gas. The rate of feeding of the gaseous mixture (i.e., the mixture of methane, the dopant and hydrogen gas) to the CVD apparatus varies depending on the size of the CVD apparatus. However, the feeding rate is generally from 0.5 to 10 liters/min, preferably from 0.6 to 8 liters/min, more preferably from 1 to 5 liters/min. The pressure in the CVD apparatus is preferably from 15 to 760 Torr, more preferably from 20 to 300 Torr.

Next, the filament in the hot filament CVD apparatus is heated to a temperature in the range of from 1,800 to 2,800° C., i.e., a temperature range which causes generation of a hydrogen radical and the like, and the conductive substrate is placed in the CVD apparatus so as to be heated to a temperature in the range of from 750 to 950° C., at which diamond can be deposited. By this operation, conductive diamond is deposited on the surface of the conductive substrate, thereby forming a conductive diamond coating layer on the conductive substrate. Thus, a conductive diamond-coated electrode is obtained.

From the viewpoint of improving the adhesion between the conductive substrate and the conductive diamond coating layer, it is preferred to polish the surface of the conductive substrate prior to the formation of the conductive diamond coating layer on the conductive substrate. The arithmetic mean roughness (Ra) of the surface of the conductive substrate after polishing is preferably from 0.1 to 15 μm, more preferably from 0.2 to 3 μm. The maximum height (Rz) of the surface profile of the conductive substrate after polishing is preferably from 1 to 100 μm, more preferably from 2 to 10 μm. Further, attaching diamond powder (as a growth nucleus) to the surface of the conductive substrate is effective for uniformly growing a conductive diamond coating layer on the conductive substrate.

By the above-described method, a layer comprised of fine particles of diamond is formed as a conductive diamond coating layer on the conductive substrate, wherein the sizes of the diamond particles are generally from 0.001 to 2 μm, preferably from 0.002 to 1 μm. In the above-described method, the thickness of the conductive diamond coating layer to be formed can be adjusted by appropriately choosing the period for which the chemical vapor deposition is performed. As mentioned above, from the viewpoint of economy, the thickness of the conductive diamond coating layer is preferably from 1 to 20 μm, more preferably from 1 to 10 μm.

With respect to the cathode, an explanation is given below. As mentioned above, the cathode is not specifically limited so long as the cathode is made of a material which is conventionally used in the field of the electrolysis of a hydrogen fluoride-containing molten salt. Examples of cathode materials include nickel and iron.

With respect to the electrolytic cell, an explanation is given below. The electrolytic cell is partitioned into an anode chamber and a cathode chamber by a partition wall (e.g., a skirt), and the anode is disposed in the anode chamber, and the cathode is disposed in the cathode chamber.

The partition wall is disposed for preventing fluorine or nitrogen trifluoride from being mixed with hydrogen during the electrolysis, wherein the fluorine or nitrogen trifluoride is generated at the anode and the hydrogen is generated at the cathode. In general, the partition wall is disposed vertically.

With respect to the material for the partition wall, there is no particular limitation so long as the material is one which is conventionally used as a material for a partition wall employed in the field of the electrolysis of a hydrogen fluoride-containing molten salt. As an example of the partition wall, there can be mentioned monel, which is an alloy of nickel and copper.

With respect to the material for the electrolytic cell, there is no particular limitation so long as the material is one which is conventionally used as a material for an electrolytic cell employed in the field of the electrolysis of a hydrogen fluoride-containing molten salt. From the viewpoint of the corrosion resistance to a high temperature hydrogen fluoride, it is preferred to use soft steel, a nickel alloy, a fluorine-containing resin or the like as the material for the electrolytic cell.

With respect to the shape of the electrolytic cell, there is no particular limitation so long as the shape is one which is conventionally used as the shape of an electrolytic cell employed in the field of the electrolysis of a hydrogen fluoride-containing molten salt. The electrolytic cell is generally columnar, preferably cylindrical or rectangularly parallelepipedic. When the electrolytic cell is columnar, the electrolytic cell can be uniformly heated through the circumferential surface thereof by using the below-mentioned temperature adjusting means. Also, when the electrolytic cell is columnar, the electrodes are disposed concentrically, so that the distribution of the current in the electrolytic cell becomes uniform throughout the cell, thereby rendering it possible to achieve a stable electrolysis.

Further, when the electrolytic cell is rectangularly parallelepipedic, the electrolytic cell can be uniformly heated through the circumferential surface thereof by using the below-mentioned temperature adjusting means.

With respect to the shape of the partition wall, there is no particular limitation so long as the shape is one which is conventionally used as the shape of a partition wall employed in the field of the electrolysis of a hydrogen fluoride-containing molten salt. The partition wall is generally columnar, preferably cylindrical or rectangularly parallelepipedic.

Figure 6:
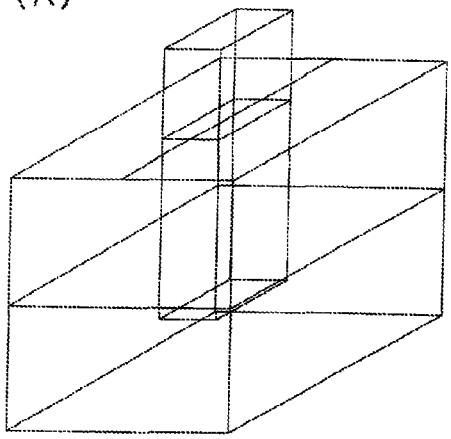
FIG. 6 shows three examples of the shapes of the electrolytic cell and partition wall used in the electrolytic apparatus of the present invention.
Figure 6:
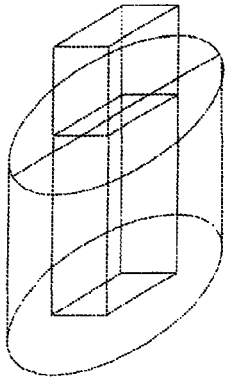
Figure 6:
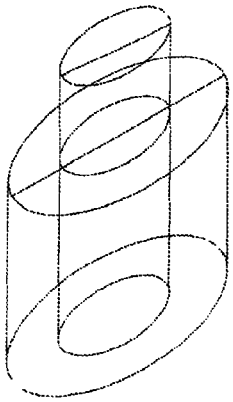

With respect to the combination of the shape of the electrolytic cell and the shape of the partition wall, there is no particular limitation so long as the combination is one which is conventionally used in the field of the electrolysis of a hydrogen fluoride-containing molten salt. Specifically, for example, there can be used a combination in which both the electrolytic cell and the partition wall are rectangularly parallelepipedic (see FIG. 6(A)); a combination in which the electrolytic cell is cylindrical and the partition wall is rectangularly parallelepipedic (see FIG. 6(B)); and a combination in which both the electrolytic cell and the partition wall are cylindrical (see FIG. 6(C)).

The ratio of the horizontal cross-sectional area of the cathode chamber to the horizontal cross-sectional area of the anode chamber is preferably 2 or more, more preferably 4 or more. The ratio of the horizontal cross-sectional area of the cathode chamber to the horizontal cross-sectional area of the anode chamber is desired to be as high as possible. There is no limitation with respect to the above-mentioned ratio; however, from a practical viewpoint, the upper limit of the ratio is generally 10. The reason why the ratio of the horizontal cross-sectional area of the cathode chamber to the horizontal cross-sectional area of the anode chamber is preferably 2 or more is as follows.

By the use of the electrolytic apparatus of the present invention, the occurrence of the anode effect can be surely prevented, as compared to the case of the prior art, thereby rending it possible to perform the electrolysis at a current density which is far higher than that in the case of the prior art. If the electrolysis of a hydrogen fluoride-containing molten salt as an electrolysis liquid is performed at such a high current density, hydrogen gas is generated in a large amount at the cathode, thus posing the following problems. If hydrogen gas is generated in a large amount, it is possible that hydrogen gas bubbles drifting about in the electrolysis liquid in the cathode chamber go under the partition wall to enter the anode chamber, where the hydrogen is combined with fluorine to form hydrogen fluoride, resulting in a lowering of the production efficiency of fluorine. Further, hydrogen gas is so light and hydrogen gas bubbles are so fine that, when a large amount of hydrogen gas is evolved, the hydrogen gas bubbles ascend and are vigorously convected in the electrolysis liquid in the cathode chamber, and the gas bubbles are likely to accumulate to form a bubble layer on the surface of the electrolysis liquid, resulting in that the apparent height of the surface of the electrolysis liquid in the cathode chamber is significantly elevated due to the formation of the bubble layer. Therefore, when the height of the surface of the electrolysis liquid in the cathode chamber is detected using the cathode chamber liquid surface detecting means as described below, the liquid surface detecting means cannot make a correct detection of the actual height of the liquid surface. This erroneous detection of the height of the liquid surface is likely to hinder the operation of the electrolytic apparatus.

The present inventors have found that the above problems can be solved by increasing the horizontal cross-sectional area of the cathode chamber to a value which is larger than that of the anode chamber, more specifically 2 times or more that of the anode chamber. When the horizontal cross-sectional area of the cathode chamber is larger than that of the anode chamber, hydrogen gas bubbles are well held in the cathode chamber and, hence, do not go under the partition wall to enter the anode chamber. Further, the apparent elevation of the height of the liquid surface becomes negligible. Therefore, the above-mentioned problems are eliminated.

The electrolytic apparatus of the present invention is preferably provided with an anode chamber pressure adjusting means for adjusting the internal pressure of the anode chamber and a cathode chamber pressure adjusting means for adjusting the internal pressure of the cathode chamber. In this preferred embodiment of the present invention, the internal pressures of the anode chamber and cathode chamber can be adjusted to be equal to each other. The equal internal pressure of the anode chamber and cathode chamber is advantageous in that the height of the liquid surface of the anode chamber and that of the cathode chamber can be kept equal and constant. When the height of the liquid surface of the anode chamber and that of the cathode chamber cannot be kept equal and constant, the following problems arise.

When the height of the liquid surface of the anode chamber and that of the cathode chamber cannot be kept equal and constant, the liquid surfaces of the anode and cathode chambers are individually fluctuated. In the worst case, the liquid surface of any of the anode and cathode chambers is lowered to a level below the partition wall of the electrolytic cell. In this case, there is a possibility that a gas contained in the chamber in which the liquid surface is lowered will enter the other chamber. Thus, a reaction occurs between $F_2$ and $H_2$ to generate HF, resulting in a current efficiency lowering and a purity lowering of $F_2$ (i.e., an increase in the HF concentration of $F_2$). Further, if the liquid surface is fluctuated, a criterion for performing feeding HF cannot be correctly applied, thus posing the problem that the composition of the electrolysis liquid cannot be correctly adjusted. (When the height of the liquid surface of the anode chamber and that of the cathode chamber are kept equal and constant, the HF concentration of the electrolysis liquid can be adjusted with high precision.) The internal pressure of the anode chamber and that of the cathode chamber can be kept equal by a smooth performance of the gas feeding to the electrolytic cell (or the generation of a gas in the electrolytic cell) and a smooth performance of the gas withdrawal from the electrolytic cell. When smooth performances of the above-mentioned operations cannot be effected, it indicates the occurrence of trouble (e.g., a trouble in the electrolysis, clogging of conduits, incomplete closure of valves, or leakage of conduits). When trouble arises, it is required to take measures, e.g., checking the system containing the electrolytic apparatus.

When the anode chamber pressure adjusting means and the cathode chamber pressure adjusting means are employed, the implementation and operation thereof may be as follows. First, an explanation is given about the anode chamber pressure adjusting means. The anode chamber pressure adjusting means is provided, e.g., in the following way: A conduit for feeding an inert gas from the top panel of the anode chamber 6 to the anode chamber 6 is provided, and the conduit is connected to a nitrogen gas bomb, thereby rending it possible to introduce nitrogen as an inert gas from the gas bomb through the conduit to the anode chamber 6. The anode chamber 6 is provided with an anode chamber pressure detecting means 15 (e.g., a pressure gauge) for detecting the internal pressure of the anode chamber 6. Further, an electromagnetic automatic valve 11 which is openable and closable in accordance with the detection results of the anode chamber pressure detecting means 15, is attached to the downstream of the anode gas outlet 9 (hereinafter, an "electromagnetic automatic valve" is frequently referred to simply as "automatic valve"). The arrangement comprising these means and parts is used as the anode chamber pressure adjusting means. During the operation of the electrolytic apparatus, nitrogen gas is appropriately fed from the gas bomb through the conduit to the anode chamber 6, and the automatic valve 11 is appropriately opened and closed in accordance with the detection results of the anode chamber pressure detecting means 15, thereby adjusting the internal pressure of the anode chamber 6. The same explanation as above applies also to the implementation and operation of the cathode chamber pressure adjusting means.

It is preferred that the anode chamber 6 is provided with an anode chamber liquid surface detecting means 13 for detecting the height of the surface of the electrolysis liquid in the anode chamber 6, and the cathode chamber 7 is provided with a cathode chamber liquid surface detecting means 14 for detecting the height of the surface of the electrolysis liquid in the cathode chamber 7. When these detecting means are provided, the height of the surface of the electrolysis liquid in each of the anode and cathode chambers can be known accurately, even when the inside of the electrolytic cell cannot be visually observed. Based on the detection results of the anode chamber liquid surface detecting means and the detection results of the cathode chamber liquid surface detecting means, a raw material for the electrolysis liquid (hydrogen fluoride (HF) and/or ammonia ($NH_3$)) can be appropriately supplied so that the height of the surface of the electrolysis liquid in the anode chamber and that of the electrolysis liquid in the cathode chamber can be adjusted to be equal and constant. Therefore, it becomes possible to prevent the electrolysis liquid from flowing backward and to perform electrolysis more stably. An example of a detecting means used as an anode chamber liquid surface detecting means and a cathode chamber liquid surface detecting means is a level probe (e.g., a level probe which can detect the height of the surface of the electrolysis liquid in five levels or more).

Hereinbelow, an explanation is given about a method for controlling the height of the surface of the electrolysis liquid in the anode chamber and that of the electrolysis liquid in the cathode chamber, using an anode chamber liquid surface detecting means and a cathode chamber liquid surface detecting means, each of which can detect the height of the surface of the electrolysis liquid in five levels.

The height level scale for the liquid surface have five levels, i.e., levels 1 to 5 which are assigned in the descending order of height (the distance between the adjacent levels is 2 cm). The height of level 3 is the standard height (the height of the liquid surface at the start of electrolysis). The liquid surface detection is performed in both the anode chamber and the cathode chamber. Usually, by performing an internal pressure control in the anode and cathode chambers, the height of the liquid surface in each of the anode and cathode chambers is maintained around the height of level 3.

In the course of the electrolysis, hydrogen fluoride as a raw material for the electrolysis liquid is consumed. Thus, in the course of the electrolysis, the weight and volume of hydrogen fluoride in the electrolysis liquid are decreased. Therefore, when the height of the liquid surface in any of the anode and cathode chambers becomes lower than the height of level 3 (which height is the standard height of the liquid surface), feeding of hydrogen fluoride to the electrolysis liquid is started, and when the height of the liquid surface in any of the anode and cathode chambers reaches the height of level 3, the feeding is stopped. By performing such control, the amount of hydrogen fluoride in the electrolysis liquid can be stabilized with only small variations, without requiring control equipment based on a complex mechanism. As a result, the amount of hydrogen fluoride in the electrolysis liquid can be controlled with high accuracy, and stable production of fluorine or nitrogen trifluoride can performed.

Further, if great fluctuations of the liquid surface occur, due to some accident or trouble, to the extent such that the height of the liquid surface reaches the height of level 2 or level 4, the electrolysis will be stopped while raising an alert at warning level. If the operator can respond at this time point, the height of the liquid surface will be adjusted to the standard value and the electrolysis will be started again and continued. If the fluctuations of the height of the liquid surface are larger such that the height of the liquid surface reaches level 1 or level 5, the electrolytic apparatus will be brought to an emergency stop, and the conduits connecting the inside of the electrolytic apparatus to the outside thereof will be shut down by the automatic valves while raising an alert at alarm level. The term "emergency stop" means a state in which power supply is stopped except that for the control system, heating is not performed, and feeding and withdrawing of gases are not performed.

The electrolytic apparatus is preferably provided with an inert gas feeding means 20A for feeding an inert gas (e.g., nitrogen, argon, neon, krypton or xenon) to the cathode chamber. The reason why the electrolytic apparatus is preferably provided with such inert gas feeding means is as follows.

As described above, when the electrolysis of a hydrogen fluoride-containing molten salt as an electrolysis liquid is performed at a high current density, a large amount of hydrogen gas is generated at the cathode, leading to an accumulation of a large amount of gas bubbles at the surface of the electrolysis liquid in the cathode chamber, thus rending it likely that the height of the surface of the electrolysis liquid in the cathode chamber cannot be accurately detected by the cathode chamber liquid surface detecting means. However, by feeding an inert gas to the cathode chamber by the inert gas feeding means, the bubbles present at the liquid surface can be extinguished, thereby removing the possibility that an accurate detection of the height of the surface of the electrolysis liquid in the cathode chamber cannot be performed by the cathode chamber liquid surface detecting means.

If a large amount of an inert gas is introduced to the cathode chamber, the surface of the electrolysis liquid in the cathode chamber is fluctuated, or the inside of the cathode chamber is cooled locally to have an uneven temperature. Thus, there occurs an unevenness of the concentration of the electrolysis liquid in the cathode chamber or a local solidification of the electrolysis liquid, thus generating adverse effects on the electrolysis. Therefore, it is preferred that the feeding amount of an inert gas to the cathode chamber is small.

The feeding amount of an inert gas to the cathode chamber varies in accordance with the applied current density during the electrolysis. When the applied current density is less than 100 $A/dm^2$, there is no need to feed an inert gas. When the applied current density is 100 $A/dm^2$ or more to less than 500 $A/dm^2$, the feeding amount of an inert gas is about 5% by volume, based on the total volume of hydrogen gas and the inert gas. When the applied current density is 500 to 1,000 $A/dm^2$, the feeding amount of an inert gas is about 10% by volume, based on the total volume of hydrogen gas and the inert gas.

When an inert gas is fed to the cathode chamber by using an inert gas feeding means, the implementation and operation thereof may be as follows. A conduit for feeding an inert gas from the top panel of the cathode chamber to the cathode chamber is provided, and the conduit is connected to an inert gas bomb, thereby rending it possible to introduce an inert gas (e.g., nitrogen, argon, neon, krypton or xenon) from the gas bomb through the conduit to the cathode chamber. An automatic valve which is openable and closable in accordance with the detection results of the anode chamber liquid surface detecting means, is attached to the downstream of the anode gas outlet. Also, an automatic valve which is openable and closable in accordance with the detection results of the cathode chamber liquid surface detecting means, is attached to the downstream of the cathode gas outlet. The arrangement comprising these means and parts is used as the inert gas feeding means. During the operation of the electrolytic apparatus, the automatic valves are appropriately opened and closed in accordance with the detection results of the anode chamber liquid surface detecting means and the detection results of the cathode chamber liquid surface detecting means, respectively, thereby feeding an appropriate amount of an inert gas to the cathode chamber.

In the electrolysis using the electrolytic apparatus of the present invention, it is possible to perform the electrolysis at a current density which is far higher than in the case of the prior art. Therefore, there is no need to attach a large number of electrodes to the electrolytic apparatus, thereby enabling a miniaturization of the electrolytic apparatus. More specifically, in the case of the prior art, a 1,000 A scale electrolytic apparatus needs to have an electrolytic cell having a volume as large as about 400 liters, whereas, in the case of the present invention, a 1,000 A scale electrolytic apparatus has an electrolytic cell having a volume of only about 40 liters, that is, a great miniaturization can be achieved in the present invention.

For producing fluorine by using the electrolytic apparatus of the present invention, as an electrolysis liquid, there can be used an HF-containing molten salt of potassium fluoride (KF) and hydrogen fluoride (HF) (the KF/HF molar ratio is 1/x, wherein x is preferably 1.9 to 2.3) (hereinafter frequently referred to as an "HF-containing molten salt of a KF-xHF system"). In the HF-containing molten salt of a KF-xHF system, when x becomes less than 1.9, the electrolysis is likely to be unable to be continued due to a melting temperature increase and solidification of the HF-containing molten salt. On the other hand, when x becomes more than 2.3, the fluorine production is accompanied by the following disadvantages. The vapor pressure of hydrogen fluoride (HF) becomes high, and HF permeates into the conductive diamond-coated electrode, thus promoting the generation of an intercalation compound which causes a destruction of the electrode. Further, corrosion and erosion of the electrolytic cell and components thereof are likely to become increased. In addition, the loss of hydrogen fluoride (HF) becomes large.

During the electrolysis, with respect to the HF-containing molten salt of a KF-xHF system used as the electrolysis liquid, the value x (i.e., the molar ratio of hydrogen fluoride (HF) to potassium fluoride (KF)) changes due to the consumption of hydrogen fluoride. The value x can be maintained within a desired range (for example, within the range of from 1.9 to 2.3) by appropriately supplying hydrogen fluoride to the electrolytic cell.

For producing nitrogen trifluoride by using the electrolytic apparatus of the present invention, as an electrolysis liquid, there can be used an HF-containing molten salt of ammonium fluoride ($NH_4F$) and hydrogen fluoride (HF) (the $NH_4F$/HF molar ratio is 1/m, wherein m is 1 to 4) (hereinafter frequently referred to as an "HF-containing molten salt of an $NH_4F$-mHF system") or an HF-containing molten salt of ammonium fluoride, potassium fluoride (KF) and hydrogen fluoride (the $NH_4F$:KF:HF molar ratio is 1:1:n, wherein n is 1 to 7) (hereinafter frequently referred to as an "HF-containing molten salt of an $NH_4F$—KF-nHF system"). In the HF-containing molten salt of an $NH_4F$-mHF system, m is preferably 2. In the HF-containing molten salt of an $NH_4F$—KF-nHF system, n is preferably 4. Fluorine compounds other than nitrogen trifluoride can be produced by changing the composition of the electrolysis liquid.

During the electrolysis, with respect to the HF-containing molten salt of an $NH_4F$-mHF system or $NH_4F$—KF-nHF system (each of which is individually used as the electrolysis liquid), the value m (i.e., the molar ratio of hydrogen fluoride (HF) to ammonium fluoride ($NH_4F$)) or the value n (i.e., the molar ratio of hydrogen fluoride (HF) to potassium fluoride (KF)) changes due to the consumption of hydrogen fluoride. Each of the values m and n can be maintained within a desired range (for example, within the range of from 1 to 4 in the case of the value m, or within the range of from 1 to 7 in the case of the value n) by appropriately supplying hydrogen fluoride to the electrolytic cell.

In the electrolysis performed in the present invention, with respect to the temperature of the electrolysis liquid, there is no particular limitation so long as the electrolysis liquid can be maintained in a molten state. The temperature of the electrolysis liquid is preferably 70 to 120° C., more preferably 80 to 110° C., still more preferably 85 to 105° C.

The temperature of the electrolysis liquid can be adjusted by using a temperature adjusting means provided in the electrolytic cell. An example of a temperature adjusting means is equipment comprised of a heater which is closely attached to the outer surface of the electrolytic cell, a heat regulator (capable of PID (Proportional-Integral-Derivative) operation) which is connected to the heater and provided outside the electrolytic cell, and a heat detecting means (such as a thermocouple) provided inside the electrolytic cell. By the use of the temperature adjusting means, it becomes possible to maintain the temperature of the electrolysis liquid in the electrolytic cell at a constant temperature.

With respect to the method for producing an HF-containing molten salt of a KF-xHF system (wherein x is 1.9 to 2.3), there is no particular limitation, and any conventional method can be used. For example, an HF-containing molten salt of a KF-xHF system can be produced by blowing anhydrous hydrogen fluoride gas into acidic potassium fluoride. With respect to the method for producing an HF-containing molten salt of an $NH_4F$-mHF system (wherein m is 1 to 4), there is no particular limitation, and any conventional method can be used. For example, an HF-containing molten salt of an $NH_4F$-mHF system can be produced by blowing anhydrous hydrogen fluoride gas into ammonium hydrogen difluoride and/or ammonium fluoride. With respect to the method for producing an HF-containing molten salt of an $NH_4F$—KF-nHF system (wherein n is 1 to 7), there is no particular limitation, and any conventional method can be used. For example, an HF-containing molten salt of an $NH_4F$—KF-nHF system can be produced by blowing anhydrous hydrogen fluoride gas into a mixture of acidic potassium fluoride with ammonium hydrogen difluoride and/or ammonium fluoride.

Approximately several hundred ppm of water is present in the electrolysis liquid immediately after the production thereof. Therefore, in a conventional case of using a carbon electrode as an anode, for preventing the occurrence of the anode effect, it is necessary to dehydrate the electrolysis liquid, for example, by subjecting the electrolysis liquid to dehydration electrolysis, wherein the current density used for the dehydration electrolysis is as low as 0.1 to 1 $A/dm^2$. However, in the present invention which uses a conductive diamond-coated electrode as an anode, the electrolysis is free from the occurrence of the anode effect and, therefore, the dehydration electrolysis of the electrolysis liquid can be performed at a high current density so as to complete the dehydration electrolysis within a short period of time. Alternatively, the operation of the electrolytic apparatus may be initiated at a desired current density without subjecting the electrolytic liquid to the dehydration electrolysis in advance.

As described above, the electrolytic cell has an inlet for feeding thereto a hydrogen fluoride-containing molten salt as an electrolysis liquid or a raw material for the hydrogen fluoride-containing molten salt. During the operation of the electrolytic apparatus, a raw material for a hydrogen fluoride-containing molten salt is appropriately supplied to the electrolytic cell from this inlet.

As described above, the electrolysis using the electrolytic apparatus of the present invention can be performed at a high current density. In the present invention, the applied current density is generally in the range of from 1 to 1,000 $A/dm^2$. When the applied current density is less than 1 $A/dm^2$, there are almost no advantages over conventional electrolytic apparatuses. On the other hand, when the applied current density is more than 1,000 $A/dm^2$, problems arise as follows. For example, vigorous generation of fluorine gas accelerates the corrosion and erosion of components of the electrolytic apparatus and components of a system containing the electrolytic apparatus, and conduits are likely to suffer clogging. For preventing the above-mentioned acceleration of corrosion and erosion of the components and clogging of the conduits, the current density used for producing fluorine is preferably 2 to 500 $A/dm^2$, more preferably 10 to 400 $A/dm^2$, most preferably 200 to 400 $A/dm^2$, and the current density used for producing nitrogen trifluoride is preferably 10 to 200 $A/dm^2$, more preferably 40 to 150 $A/dm^2$, most preferably 110 to 150 $A/dm^2$.

In the electrolysis performed using the electrolytic apparatus of the present invention, fluorine or nitrogen trifluoride is obtained in a gaseous form.

As mentioned above, by the use of the electrolytic apparatus of the present invention, the electrolysis can be performed at a much higher current density than applied in the electrolyses using conventional apparatuses. Therefore, the electrolytic apparatus of the present invention enables the efficient production of fluorine or nitrogen trifluoride. Specifically, for example, when the volume of the electrolytic cell of the electrolytic apparatus of the present invention is about 40 liters, fluorine or nitrogen trifluoride can be produced in an amount which is about several tens to a hundred times that achieved in the case of the electrolyses performed using conventional apparatuses.

Therefore, the electrolytic apparatus of the present invention can be much more advantageously used as an on-site electrolytic apparatus in semi-conductor production plants than conventional electrolytic apparatuses. With respect to the specific advantages achieved by the use of the electrolytic apparatus of the invention, explanations are given below.

Most of the areas inside of a semiconductor production plant are clean room areas, so that the cost of a semiconductor production plant per footprint is high. Therefore, it has been demanded to reduce the size of an on-site electrolytic apparatus. In the case of a conventional electrolytic apparatus, the amount of fluorine or nitrogen trifluoride produced per unit volume of the electrolytic cell used in the electrolytic apparatus is small as compared to the case of the electrolytic apparatus of the present invention. Therefore, when the size of a conventional electrolytic apparatus is reduced, more time is needed to produce fluorine or nitrogen trifluoride in such an amount as required in the production of semiconductors, which, in turn, necessitates the reservation of gas (fluorine or nitrogen trifluoride) in a reservation apparatus prior to the feeding thereof into a reactor so as to secure the gas in such an amount as required per feeding. When a conventional electrolytic apparatus is used, the reservation of gas formed by electrolysis is performed by pressurizing the gas using a pressurizing apparatus and charging the resultant pressurized gas into a reservation apparatus; however, fluorine gas or nitrogen trifluoride gas has very high reactivity and, hence, it is dangerous to reserve such gas under high pressure. Therefore, for reserving such gas under high pressure stably for a long period of time, it is necessary to suppress the pressure of the gas to not higher than about 0.2 MPa. For this reason, when it is intended to provide a large amount of fluorine or nitrogen trifluoride using a conventional apparatus, it becomes necessary to use a large reservation apparatus, e.g., a reservation apparatus having a volume of from 500 liters to 3 $m^3$. Therefore, the use of a conventional apparatus is very disadvantageous from the viewpoint of cost per footprint of a semiconductor production plant.

On the other hand, when the electrolytic apparatus of the present invention is used in the production of fluorine or nitrogen trifluoride, the productivity of fluorine or nitrogen trifluoride per unit volume of the electrolytic cell used in the electrolytic apparatus is very high. Therefore, even when the size of the electrolytic apparatus of the present invention is small, fluorine gas or nitrogen trifluoride gas can be produced in such an amount as required in the production of semiconductors within a short period of time, so that it is not necessary to reserve the gas until a sufficient amount of the gas is collected and, hence, a reservation apparatus is not needed. Thus, the use of the electrolytic apparatus of the present invention is very advantageous from the viewpoint of cost per footprint of a semiconductor production plant.

The omission of a reservation apparatus is also preferred from the viewpoint of preventing the gas leakage explained below. However, when it is considered that the use of a reservation apparatus is favorable with all things considered, a reservation apparatus may be used.

The reason why the electrolytic apparatus of the present invention is free from the anode effect and, hence, enables the electrolysis at a high current density is considered as follows. In the electrolysis apparatus of the present invention, a coating layer comprised of a conductive carbonaceous material having a diamond structure is formed on the surface of the conductive substrate, but a conductive carbonaceous material having no diamond structure and forming the conductive substrate may be exposed at a part of the surface of the conductive substrate without being coated with the coating layer. With respect to the carbonaceous material having no diamond structure, which is exposed at a part of the surface of the conductive substrate to the electrolysis liquid comprising the hydrogen fluoride-containing molten salt, graphite fluoride ($(CF)_n$) is formed on the carbonaceous material as the electrolysis proceeds. The graphite fluoride has a low wettability with the electrolysis liquid and, hence, stably protects the anode. On the other hand, with respect to the carbonaceous material having a diamond structure and forming the coating layer, the diamond structure of the carbonaceous material is caused to have fluorine-terminals as the electrolysis proceeds, so that the sp3-bonds in the diamond structure are not broken and, hence, a dopant (such as boron, phosphorus or nitrogen) which imparts conductivity to the carbonaceous material having a diamond structure does not dissolve out from the diamond structure of the carbonaceous material. Therefore, by the use of the electrolysis apparatus of the present invention, the electrolysis can be stably performed for a ling period of time.

Further, in the electrolysis using the electrolytic apparatus of the present invention, the electrodes of the electrolysis apparatus suffer almost no erosion and almost no generation of sludge, so that it is not necessary to frequently change the electrodes or refresh the electrolysis liquid. Therefore, by the use of the electrolysis apparatus of the present invention, it becomes possible to reduce the frequency of the suspension of the electrolysis for refreshing the electrodes or the electrolysis liquid. This means that a stable production of fluorine or nitrogen trifluoride can be performed for a long period of time only by supplying a raw material (such as hydrogen fluoride (HF) or ammonia ($NH_3$)) for the electrolysis liquid, without suspending the electrolysis for refreshing the electrodes or the electrolysis liquid.

Thus, according to the present invention, the electrolysis for producing fluorine or nitrogen trifluoride can be performed using a smaller electrolytic cell than used in the conventional techniques. When the electrolysis is performed using a smaller electrolytic cell than used in the conventional techniques, it becomes necessary to frequently supplement hydrogen fluoride (HF) consumed in the electrolysis. Therefore, in such a case, the concentration of the hydrogen fluoride (HF) in the electrolysis liquid greatly fluctuates during the electrolysis. However, the conductive diamond-coated electrode as the anode used in the electrolytic apparatus of the present invention has a high durability such that the anode does not suffer the anode effect.

As mentioned above, the anode chamber has an anode gas outlet for withdrawing gas from the electrolytic cell, and the cathode chamber has a cathode gas outlet for withdrawing gas from the electrolytic cell. In the electrolysis performed using the electrolytic apparatus of the present invention, gas is produced at each of the anode and the cathode. The gas produced at the anode is comprised mainly of fluorine or nitrogen trifluoride, and the gas produced at the cathode is comprised mainly of hydrogen. The gas produced at the anode is withdrawn from the electrolytic cell through the anode gas outlet. If desired, the gas withdrawn from the electrolytic cell through the anode gas outlet may be transported to a purification apparatus so as to purify the gas. As the purification apparatus, the below-mentioned apparatus as a purification apparatus for the system of the present invention can be used. Furthermore, the gas produced at the cathode is withdrawn from the electrolytic cell through the cathode gas outlet. If desired, the gas withdrawn from the electrolytic cell through the cathode gas outlet may be transported to a purification apparatus so as to purify the gas. With respect to the gas withdrawn from the electrolytic cell through the cathode gas outlet, it is preferred that the gas is mixed with an inert gas (such as nitrogen, argon, neon, krypton or xenon) to dilute the gas and the resultant gaseous mixture is released into the air, thereby lowering the hydrogen content of the gas released into the air so as to prevent the explosion of hydrogen.

The electrolytic apparatus of the present invention can be used for stably feeding fluorine or nitrogen trifluoride to a reactor (in which a reaction using fluorine or nitrogen trifluoride is performed) for a long period of time. Moreover, the electrolytic apparatus of the present invention can be used for providing a system for stably feeding fluorine or nitrogen trifluoride for a long period of time to a reactor performing a desired reaction. As mentioned above, in the electrolytic apparatus of the present invention, the size of the electrolytic cell can be reduced without scarifying the performance of the electrolytic apparatus, so that the sizes of the electrolytic apparatus of the present invention and the system using the apparatus of the present invention can also be reduced. Therefore, the system of the present invention can be installed on-site in a semiconductor production plant and the like, which means that the system of the present invention can be provided at a location close to a reactor (for performing a reaction using fluorine or nitrogen trifluoride) in a semiconductor production plant and the like.

The system of the present invention is used for feeding fluorine or nitrogen trifluoride to a reactor 35 for performing a reaction using fluorine or nitrogen trifluoride. The system comprises the electrolytic apparatus of the present invention, and either one or both of a purification apparatus 25 and a pressurizing apparatus 26. That is, in addition to the electrolytic apparatus, the system of the present invention comprises either one of a purification apparatus 25 and a pressurizing apparatus 26 or both of a purification apparatus 25 and a pressurizing apparatus 26. Hereinbelow, a specific explanation is given with respect to the case where the system of the present invention comprises both of a purification apparatus 25 and a pressurizing apparatus 26 as well as the electrolytic apparatus of the present invention. Based on the following explanation on such a system comprising both of a purification apparatus 25 and a pressurizing apparatus 26 as well as the electrolytic apparatus of the present invention, a person skilled in the art can easily produce a system which comprises one of a purification apparatus 25 and a pressurizing apparatus 26 as well as the electrolytic apparatus of the present invention.

When the system of the present invention comprises a purification apparatus and a pressurizing apparatus as well as the electrolytic apparatus of the present invention, the fluorine or the nitrogen trifluoride which has been produced using the electrolytic apparatus is purified using the purification apparatus, and the resultant purified fluorine or nitrogen trifluoride is pressurized using the pressurizing apparatus. Thus, during the operation of the system of the present invention, feeding of fluoride or nitrogen trifluoride from the system to the reactor for performing a reaction using fluoride or nitrogen trifluoride is performed through the pressurizing apparatus.

During the operation of the system of the present invention, the rate of feeding fluoride or nitrogen trifluoride to the reactor can be controlled by adjusting the amount of current applied to the electrolytic apparatus.

Examples of reactors for performing a reaction using fluorine or nitrogen trifluoride include an apparatus for chamber-cleaning of a LPCVD (low pressure CVD) apparatus and an apparatus for surface treatment of molded articles of olefin polymers.

In the electrolysis performed using the electrolytic apparatus of the present invention, fluorine or nitrogen trifluoride is obtained in the form of a gas containing impurities. Examples of impurities include by-product gases (such as hydrogen fluoride gas), and substances entrained by the hydrogen fluoride-containing molten salt used as the electrolysis liquid. The above-mentioned purification apparatus is an apparatus used for removing impurities from the produced fluorine or nitrogen trifluoride to obtain fluorine or nitrogen trifluoride in the form of a high purity gas. In the present invention, when fluorine gas is produced using a hydrogen fluoride-containing molten salt of a KF-xHF system as the electrolysis liquid, hydrogen fluoride and/or oxygen is formed as a by-product gas. When nitrogen trifluoride gas is produced using a hydrogen fluoride-containing molten salt of an $NH_4$-mHF system or an $NH_4F$—KF-nHF system as the electrolysis liquid, hydrogen fluoride, nitrogen, oxygen and/or nitrous oxide is formed as a by-product gas. Further, as examples of substances entrained by the hydrogen fluoride-containing molten salt, there can be mentioned liquid hydrogen fluoride, liquid ammonium fluoride and liquid potassium fluoride, each contained in the molten salt.

With respect to the specific method for removing the impurities, the above-mentioned hydrogen fluoride gas can be removed by passing the produced gas through a column packed with sodium fluoride granules; the above-mentioned nitrogen gas can be removed by passing the produced gas through a liquid nitrogen trap; the above-mentioned oxygen gas can be removed by passing the produced gas through a column packed with an activated carbon; the above-mentioned nitrous oxide can be removed by passing the produced gas through a container containing water and sodium thiosulfate; and the above-mentioned substances entrained by the hydrogen fluoride-containing molten salt can be removed by a filter made of a sintered monel or a sintered hastelloy. Therefore, by using a purification apparatus comprising the above-mentioned trap, column, container and filter which are connected in series, the impurities can be removed from the produced gas. By removing the impurities from the produced gas, fluorine or nitrogen trifluoride can be obtained in the form of a high purity gas. The purities of the purified fluorine and nitrogen trifluoride are generally 99.9% or more and 99.999% or more, respectively.

With respect to the electrolytic apparatus of the present invention, even when the size of the electrolytic apparatus is small, fluorine or nitrogen trifluoride can be produced at a high production rate by applying a large amount of current to the electrolytic apparatus. As mentioned above, when the electrolysis is performed using the electrolytic apparatus of the present invention, the productivity of fluorine or nitrogen trifluoride becomes several tens to a hundred times that achieved in the case where a conventional electrolytic apparatus is used. Therefore, fluorine or nitrogen trifluoride can be fed to the reactor (provided downstream of the system) in such an amount as required in the reactor simply by feeding the produced fluorine or nitrogen trifluoride which, after withdrawn from the electrolytic apparatus, has been purified using the purification apparatus and, then, pressurized using the pressurizing apparatus. As mentioned above, when the electrolytic apparatus of the present invention is used, it is not necessary to reserve the pressurized gas (i.e., fluorine or nitrogen trifluoride) in a reservation apparatus provided downstream of the above-mentioned pressurizing apparatus. Therefore, even when a gas leakage from the electrolytic apparatus occurs during the electrolysis performed using the system of the present invention without using a reservation apparatus, the gas leakage can be stopped instantaneously simply by stopping the electrolysis because the gas produced using the electrolytic apparatus is not reserved prior to the feeding thereof to the reactor.

In the operation of the system of the present invention, the feeding of fluorine or nitrogen trifluoride from the system to a reactor for performing a reaction using fluorine or nitrogen trifluoride is performed through the pressurizing apparatus, wherein the rate of feeding fluoride or nitrogen trifluoride to the reactor can be controlled by adjusting the amount of current applied to the electrolysis apparatus.

Examples of pressurizing apparatuses include a bellows supply pump, and a diaphragm supply pump.

With respect to the system of the present invention, it is preferred that the system is provided with a means for mixing gas withdrawn from the cathode gas outlet with an inert gas (such as nitrogen, argon, neon, krypton or xenon) to dilute the gas withdrawn, followed by removal of the resultant diluted gas from the system. By the use of such a diluting means, it becomes possible to release the gas (withdrawn from the electrolytic apparatus through the cathode gas outlet) into the air in the form of a diluted gaseous mixture with an inert gas, thereby lowering the hydrogen content of the gas released into the air so as to prevent the explosion of hydrogen. As an example of the above-mentioned diluting means, there can be mentioned a means comprising a gas bomb for introducing an inert gas into the cathode chamber of the electrolytic cell, and a conduit connecting the gas bomb and the top panel of the cathode chamber of the electrolytic cell, wherein the inert gas is introduced into the cathode chamber from the gas bomb through the conduit.

In the present invention, the electrolytic apparatus, the purification apparatus 25 and the pressurizing apparatus 26 may be accommodated in a casing 1. By accommodating the above-mentioned apparatuses in a casing, it becomes possible to control the atmosphere around the electrolytic apparatus, thereby preventing the reaction of fluorine gas with carbon dioxide gas present in the air (which reaction forms carbon tetrafluoride ($CF_4$)). Further, even when a fluorine gas leakage from the electrolytic apparatus occurs, the leakage of the gas to the outside of the system can be surely prevented.

In the present invention, generally, conduits are used for connecting the electrolytic apparatus and the purification apparatus, for connecting the purification apparatus and the pressurizing apparatus, and for connecting the pressurizing apparatus and the reactor. There is no particular limitation with respect to the material for the conduits, and any of the conventional materials may be used so long as the materials do not react with the gas (fluorine or nitrogen trifluoride) to be produced using the system of the present invention. Examples of conventional materials for the conduits include SUS316, SUS316L, Ni, monel, copper and brass.

As mentioned above, by the use of the electrolytic apparatus of the present invention, the production of fluorine or nitrogen trifluoride can be stably and efficiently performed for a long period of time without the occurrence of the anode effect or anodic dissolution. Therefore, by the use of the system of the present invention containing the electrolytic apparatus of the present invention, it becomes possible to stably feed fluorine or nitrogen in the form of a high purity gas to a reactor.

Hereinbelow, the present invention will be described in more detail with reference to the following Examples and Comparative Examples, but they should not be construed as limiting the scope of the present invention.

In the following Examples and Comparative Examples, various properties and characteristics were evaluated and measured as follows.

Measurement of arithmetic mean roughness (Ra) of the surface of a conductive substrate and maximum height (Rz) of the surface profile of the conductive substrate:

The arithmetic mean roughness (Ra) of the surface of a conductive substrate and the maximum height (Rz) of the surface profile of the conductive substrate were measured using a portable surface roughness measurement instrument (SJ-400; manufactured and sold by Mitsutoyo Corporation, Japan).

Raman Spectroscopic Analysis:

A Raman spectroscopic analysis was performed using a Raman spectrometer (Nicolet Almega XR) manufactured and sold by Thermo-Electron Corporation, Japan. The analysis was performed using a laser at 532 nm.

X-Ray Diffraction Analysis:

An X-ray diffraction analysis was performed using an X-ray diffraction apparatus (RINT2100V) manufactured and sold by Rigaku Corporation, Japan. CuKα ray was used as an X-ray source, and the analysis was performed under conditions wherein the accelerating voltage was 40 KV, the accelerating current was 30 mA and the scan speed was 2°/min.

Efficiency of Gaseous Fluorine Production:

A gaseous product was flowed through a reaction tube packed with calcium chloride (KCl) for a predetermined period of time. In the reaction tube, gaseous chlorine ($Cl_2$) was generated by the reaction of fluorine contained in the gaseous product with calcium chloride (KCl) packed in the reaction tube (this reaction is represented by formula (6) below). The generated gaseous chlorine ($Cl_2$) was blown into an aqueous potassium iodide (KI) solution to react the gaseous chlorine ($Cl_2$) with potassium iodide (KI), thereby generating iodine ($I_2$) (this reaction is represented by formula (7) below).

$$F_2+2KC \rightarrow 2KF+Cl_2 \quad (6)$$

$$Cl_2+2KI \rightarrow 2KCl+I_2 \quad (7)$$

The amount of the generated iodine ($I_2$) was measured by iodometry (i.e., quantitative method which is based on a reaction represented by formula (8) below).

$$2Na_2S_2O_3+I_2 \rightarrow 2NaI+Na_2S_4O_6 \quad (8)$$

As apparent from formulae (6) to (8) above, the molar amount of gaseous fluorine contained in the gaseous product is equivalent to half the molar amount of sodium thiosulfate ($Na_2S_2O_3$) used in the iodometry. Accordingly, the amount $M_{exp}$ (mol) of gaseous fluorine contained in the gaseous product was calculated using the following formula (9):

$$M_{exp}=N\times(L/2) \quad (9)$$

wherein N represents the sodium thiosulfate concentration (mol/liter) of a titrant, and L represents the amount (liter) of the titrant.

On the other hand, the theoretical amount $M_{theo}$ (mol) of the produced gaseous fluorine, which is based on the amount of applied electricity, was calculated using the following formula (10):

$$M_{theo}=I\times t/nF \quad (10)$$

wherein I represents the electrolytic current (A), t represents the conducting time (sec), F represents Faraday's constant (96,500 C/mol), and n represents the number of electrons involved in the fluorine production reaction (n=2).

The efficiency of gaseous fluorine production (%) is $(M_{exp}/M_{theo})\times 100$.

Efficiency of gaseous nitrogen trifluoride production:

The amount (% by volume) of nitrogen trifluoride contained in the gaseous product was measured by gas chromatography, and the efficiency of gaseous nitrogen trifluoride production was calculated in accordance with the following formula (11):

$$\text{Efficiency}(\%)=(n\times F\times P\times V\times f)/(6\times 10^4\times R\times I) \quad (11)$$

wherein:

n: number of electrons involved in the nitrogen trifluoride production reaction, F: Faraday's constant (96,500 C/mol), P: pressure (atm), V: amount (% by volume) of nitrogen trifluoride, f: flow rate of nitrogen trifluoride ($10^{-3}$ $cm^3$/min), R: gas constant (atm/$cm^3$/$deg^{-1}$/$mol^{-1}$), T: absolute temperature (K), and I: electrolytic current (A).

Formula (11) above is based on the assumption that the nitrogen trifluoride production reaction proceeds in accordance with formula (12) below, in which the number (n) of electrons involved is 6:

$$NH_4F+6HF_2^- \rightarrow NF_3+10HF+6e^- \quad (12).$$

Surface Energy at an Anode Surface:

The surface energy at an anode surface was calculated from the contact angle of water and that of methylene iodide. The surface energy is expressed in terms of dyn/cm.

Example 1

Using a graphite plate (size: 200 mm×250 mm×20 mm) as a conductive substrate, a conductive diamond-coated electrode was produced as follows, using a hot filament CVD apparatus (which was produced in accordance with the method described in non-Patent Document 3).

The whole area of each of the opposite broad surfaces of the conductive substrate was polished using diamond particles having a particle diameter of 1 μm as an abrasive. After polishing, the arithmetic mean roughness (Ra) of the surface of the conductive substrate and the maximum height (Rz) of the surface profile of the conductive substrate became 0.2 μm and 6 μm, respectively. Subsequently, diamond particles having a particle diameter of 4 nm were attached to the whole area of each of the opposite broad surfaces of the conductive substrate. The resultant substrate was placed in the hot filament CVD apparatus. A gaseous mixture which was hydrogen gas containing 1% by volume of methane gas and 0.5 ppm of trimethylboron gas was fed to the CVD apparatus at a flow rate of 5 liters/min while maintaining the internal pressure of the CVD apparatus at 75 Torr. Electricity was applied to the filament of the CVD apparatus to increase the temperature of the filament to 2,400° C., so that the temperature of the conductive substrate in the CVD apparatus became 860° C.

The CVD process was performed for 8 hours. The CVD process was continuously repeated in the same manner until a conductive diamond coating layer (a polycrystalline layer) was formed on the opposite broad surfaces of the conductive substrate, thereby obtaining a conductive diamond-coated electrode. The obtainment of a conductive diamond-coated electrode was confirmed by performing the Raman spectroscopic analysis and the X-ray diffraction analysis at the end of the CVD process. The peak intensity ratio of 1,332 $cm^{-1}$ to 1,580 $cm^{-1}$, which ratio was obtained by the Raman spectroscopic analysis, was 1:0.4.

The thickness of the conductive diamond coating layer formed on the surface of the conductive substrate was 4 μm. The thickness of the conductive diamond coating layer was measured by producing another conductive diamond-coated electrode in the same manner as mentioned above and observing a section of the conductive diamond-coated electrode under a scanning electron microscope (SEM).

The following electrolytic apparatus was produced for performing an electrolysis. A cylindrical vessel (size (inner size): ϕ300 mm×800 mm) made of nickel was used as an electrolytic cell. The electrolytic cell was partitioned into an anode chamber and a cathode chamber by a partition wall which was made of monel and which was positioned vertically in the form of a thin doughnut shape, wherein the chamber located inside the partition wall was the anode chamber and the chamber located outside the partition wall was the cathode chamber. The ratio of the horizontal cross-sectional area of the cathode chamber to the horizontal cross-sectional area of the anode chamber was 2.5. The electrolytic cell had an inlet (provided in the cathode chamber) for feeding thereto an HF-containing molten salt as an electrolysis liquid or a raw material for the HF-containing molten salt, the anode chamber had an anode gas outlet for withdrawing gas from the electrolytic cell, and the cathode chamber had a cathode gas outlet for withdrawing gas from the electrolytic cell. The above-mentioned conductive diamond-coated electrode was used as an anode and two nickel plates (size: 100 mm×250 mm×5 mm) were used as a cathode, wherein the two nickel plates were disposed in a manner such that the anode was sandwiched therebetween.

The anode chamber was provided with a level probe which was used as an anode chamber liquid surface detecting means for detecting the height of the surface of the electrolysis liquid in the anode chamber, and the cathode chamber was provided with a level probe which was used as a cathode chamber liquid surface detecting means for detecting the height of the surface of the electrolysis liquid in the cathode chamber, so that when there was a large change in the height of the surface of the electrolysis liquid, the liquid surface detecting means would detect such a change and, in turn, would cause an operation of a safety circuit which terminates the operation of the electrolytic apparatus.

Further, the electrolytic cell was provided with an inert gas feeding means for feeding an inert gas to the electrolytic cell, as follows. A conduit for feeding an inert gas was drawn into the cathode chamber from the top panel thereof so that nitrogen gas as an inert gas could be fed to the cathode chamber from a gas bomb. Further, at the outer edge portion of the anode gas outlet was provided an automatic valve which was openable and closable in accordance with the height of the surface of the electrolysis liquid in the anode chamber, wherein the height was detected by the anode chamber liquid surface detecting means. Also, at the outer edge portion of the cathode gas outlet was provided an automatic valve which was openable and closable in accordance with the height of the surface of the electrolysis liquid in the cathode chamber, wherein the height was detected by the cathode chamber liquid surface detecting means. The arrangement comprising these means and parts was used as the inert gas feeding means.

Further, the electrolytic cell was provided with an anode chamber pressure adjusting means for adjusting the internal pressure of the anode chamber and a cathode chamber pressure adjusting means for adjusting the internal pressure of the cathode chamber. The anode chamber pressure adjusting means was provided as follows. A conduit for feeding an inert gas was drawn into the anode chamber from the top panel thereof so that nitrogen gas as an inert gas could be fed to the anode chamber from a gas bomb. The anode chamber was provided with a pressure gauge used as an anode chamber pressure detecting means for detecting the internal pressure of the anode chamber. At the outer edge portion of the anode gas outlet was provided an automatic valve which was openable and closable in accordance with the pressure of the anode chamber, wherein the pressure was detected by the anode chamber pressure detecting means. The arrangement comprising these means and parts was used as the anode chamber pressure adjusting means. The cathode chamber pressure adjusting means was also provided in the same manner as in the case of the anode chamber pressure adjusting means.

In addition, there was provided a heat adjusting means. This heat adjusting means was comprised of a heater closely attached to the outer surface of the electrolytic apparatus, a heat regulator (capable of PID operation) connected to the heater and provided outside the electrolytic apparatus, and a thermocouple (heat detecting means) provided inside the electrolytic cell.

Using the thus-produced electrolytic apparatus, an electrolysis was performed. Specifically, a fresh hydrogen fluoride-containing molten salt of a KF-2HF system charged into the electrolytic cell as an electrolysis liquid, and the electrolysis was performed for 48 hours under conditions wherein the electric current was 1,000 A and the current density was 125 $A/dm^2$. During the electrolysis, the internal pressure of the anode chamber and the internal pressure of the cathode chamber were maintained at a superatmospheric pressure of 0.17 kPaG using the above-mentioned anode chamber pressure adjusting means and cathode chamber pressure adjusting means, respectively. Further, during the electrolysis, the temperature of the electrolysis liquid was maintained at 90° C. using the above-mentioned temperature adjusting means. At an appropriate timing during the electrolysis, liquid hydrogen fluoride (HF) was added from the above-mentioned inlet to the electrolytic cell, based on the detection results of the anode chamber liquid surface detecting means and the detection results of the cathode chamber liquid surface detecting means. The liquid hydrogen fluoride was added not only to keep the height of the liquid surface in the anode chamber and the height of the liquid surface in the cathode chamber at an equal and constant level, but also to maintain the molar ratio of hydrogen fluoride (HF) contained in the HF-containing molten salt to potassium fluoride (KF) contained in the HF-containing molten salt at 2.1. In addition, based on the detection results of the anode chamber liquid surface detecting means and the detection results of the cathode chamber liquid surface detecting means, nitrogen gas as an inert gas was fed to the cathode chamber using the inert gas feeding means (the amount of nitrogen gas fed was 0.35 liter/min).

The gas produced at the anode was withdrawn from the electrolytic cell through the anode gas outlet by using a pressurizing apparatus. The gas produced at the cathode was withdrawn from the electrolytic cell through the cathode gas outlet, and the withdrawn gas was mixed with nitrogen gas to dilute the withdrawn gas, followed by discharging of the resultant diluted gas into the air.

As a result of the electrolysis, gaseous fluorine was produced at a rate of 7 liters/min (the volume of the produced fluorine was measured at room temperature under atmospheric pressure). The efficiency of gaseous fluorine production was at least 98%.

After completion of the electrolysis, the conductive diamond-coated electrode was taken out from the electrolytic cell and washed with anhydrous hydrogen fluoride. After drying satisfactorily, the weight of the conductive diamond-coated electrode was measured. The weight of the conductive diamond-coated electrode after the drying was substantially the same as the weight of the electrode at the start of the electrolysis and, therefore, almost no erosion of the electrode occurred. Further, no sludge generation was recognized by visual observation of the electrolysis liquid immediately after the termination of the electrolysis.

Comparative Example 1

An electrolytic apparatus was produced in substantially the same manner as in Example 1, except that a carbon plate (size: 200 mm×250 mm×20 mm) was used as the anode.

Using the produced electrolytic apparatus, an electrolysis was performed. Specifically, a fresh hydrogen fluoride-containing molten salt of a KF-2HF system was charged into the electrolytic cell as an electrolysis liquid, and the electrolysis was performed under conditions wherein the electric current was 1,000 A and the applied current density was 125 A/dm$^2$. The anode effect occurred approximately 15 minutes after the start of the electrolysis, thereby rendering it completely impossible to continue the electrolysis.

After it became impossible to continue the electrolysis, the carbon plate used as the anode was taken out from the electrolytic apparatus for visual observation. As a result of visual observation, it was confirmed that a graphite fluoride film was formed on the surface of the carbon plate and, hence, the carbon plate as the anode was not wetted with the electrolysis liquid at all.

Example 2

An electrolysis was performed in substantially the same manner as in Example 1, except that a fresh HF-containing molten salt of an $NH_4F$-2HF system was used as the electrolysis liquid, that hydrogen fluoride (HF) and ammonia ($NH_3$) were used as raw materials for the electrolysis liquid which were fed from the inlet during the electrolysis, and that the molar ratio of hydrogen fluoride (HF) contained in the HF-containing molten salt to ammonium fluoride ($NH_4F$) contained in the HF-containing molten salt was maintained at 2.

The gas produced at the anode was withdrawn from the electrolytic cell through the anode gas outlet by using a pressurizing apparatus. The gas produced at the cathode was withdrawn from the electrolytic cell through the cathode gas outlet, and the withdrawn gas was mixed with nitrogen gas to dilute the withdrawn gas, followed by discharging the resultant diluted gas into the air.

As a result of the electrolysis, gaseous nitrogen trifluoride was produced at a rate of 1 liter/min (the volume of the produced nitrogen trifluoride was measured at room temperature under atmospheric pressure). The efficiency of gaseous nitrogen trifluoride production was 60%.

After completion of the electrolysis, the conductive diamond coated-electrode was taken out from the electrolytic cell and washed with anhydrous hydrogen fluoride. After drying satisfactorily, the weight of the conductive diamond-coated electrode was measured. The weight of the conductive diamond-coated electrode after the drying was substantially the same as the weight of the electrode at the start of the electrolysis and, therefore, almost no erosion of the electrode occurred. Further, no sludge generation was recognized by visual observation of the electrolysis liquid immediately after the termination of the electrolysis.

Comparative Example 2

An electrolytic apparatus was produced in substantially the same manner as in Example 1, except that an Ni plate (size: 200 mm×250 mm×20 mm) was used as the anode. Using the produced electrolytic apparatus, an electrolysis was performed in the same manner as in Example 2.

At the beginning of the electrolysis, gaseous nitrogen trifluoride was produced at a rate of 1 liter/min (the volume of the produced nitrogen trifluoride was measured at room temperature under atmospheric pressure). The efficiency of gaseous nitrogen trifluoride production was 60%.

However, electric current stopped completely after continuing the electrolysis for 10 minutes. When the electrolytic apparatus was opened for examination, it was found that the part of the Ni plate which was immersed in the electrolysis liquid suffered corrosion and dissolution, thereby generating a nickel fluoride compound, which was deposited as a large amount of sludge in the electrolysis liquid.

Example 3

An electrolytic apparatus was produced in substantially the same manner as in Example 1, except that the ratio of the horizontal cross-sectional area of the cathode chamber to the horizontal cross-sectional area of the anode chamber was 0.5. Using the produced electrolytic cell, an electrolysis was performed. Specifically, a fresh hydrogen fluoride-containing molten salt of a KF-2HF system was charged into the electrolytic cell as an electrolysis liquid, and the electrolysis was performed under conditions wherein the electric current was 1,000 A and the applied current density was 125 A/dm$^2$. On the first day, the electrolysis was successfully continued as in Example 1, and a gaseous product was obtained. However, on the second day, the safety circuit operated due to the detection of an unusual rise in the cathode chamber liquid surface by the cathode chamber liquid surface detecting means and, as a result, the operation of the electrolytic apparatus was terminated and the electrolysis was discontinued. The cause of the termination of the operation of the electrolytic apparatus was the malfunction of the cathode chamber liquid surface detecting means, which was caused by the generation of a large amount of bubbles in the electrolysis liquid contained in the cathode chamber.

INDUSTRIAL APPLICABILITY

When the electrolytic apparatus of the present invention is used for producing fluorine or nitrogen trifluoride by electrolyzing a hydrogen fluoride-containing molten salt, the production can be performed stably and efficiently without the occurrence of the anode effect even at a high current density and without the occurrence of an anodic dissolution.

The invention claimed is:

1. A method for electrolytic production of fluorine or nitrogen trifluoride by the use of an electrolytic apparatus, said electrolytic apparatus comprising an electrolytic cell which is partitioned into an anode chamber and a cathode chamber by a partition wall, an anode which is disposed in said anode chamber, a cathode which is disposed in said cathode chamber, and an inert gas feeding means for feeding an inert gas to said cathode chamber, said electrolytic cell having an inlet for feeding thereto a hydrogen fluoride-containing molten salt as an electrolysis liquid or a raw material for said hydrogen fluoride-containing molten salt, said anode chamber having an anode gas outlet for withdrawing gas from said electrolytic cell, said cathode chamber having a cathode gas outlet for withdrawing gas from said electrolytic cell, said anode comprising a conductive substrate and a coating layer formed on at least a part of the surface of said conductive substrate, wherein at least a surface portion of said conductive substrate is comprised of a conductive carbonaceous material, wherein said coating layer is comprised of a conductive carbonaceous material having a diamond structure, wherein the ratio of the horizontal cross-sectional area of said cathode chamber to the horizontal cross-sectional area of said anode chamber is 2 or more, said method comprising electrolyzing, by the use of said electrolytic apparatus, a hydrogen fluoride-containing molten salt at an applied current density of from 100 to 1,000 $A/dm^2$ while feeding an inert gas to said cathode chamber by using said inert gas feeding means.

2. The method according to claim 1, wherein the whole of said conductive substrate of said anode of said electrolytic apparatus is comprised of a conductive carbonaceous material.

3. A method for feeding fluorine or nitrogen trifluoride to a reactor for performing a reaction using fluorine or nitrogen trifluoride, which comprises producing fluorine or nitrogen trifluoride by the use of the electrolytic apparatus recited in claim 1 or 2, and feeding the produced fluorine or nitrogen trifluoride to a reactor for performing a reaction using fluorine or nitrogen trifluoride.

* * * * *